US005709056A

United States Patent [19]

Matsuyama et al.

[11] Patent Number: 5,709,056

[45] Date of Patent: Jan. 20, 1998

[54] CLADDING UNITS FOR BUILDING AND SEAL STRUCTURE FOR JOINT THEREOF

[75] Inventors: Masahiro Matsuyama, Omiya; Fumihiro Yano, Toyama, both of Japan

[73] Assignee: YKK Corporation, Tokyo, Japan

[21] Appl. No.: 682,993

[22] Filed: Jul. 18, 1996

[30] Foreign Application Priority Data

Jul. 21, 1995 [JP] Japan ..... 7-185569
Feb. 28, 1996 [JP] Japan ..... 8-041760

[51] Int. Cl.[6] ..... E04B 2/96

[52] U.S. Cl. ..... 52/235; 52/393; 52/396.1; 52/582.1; 52/588.1; 52/509

[58] Field of Search ..... 52/235, 393, 396.1, 52/582.1, 588.1, 509, 513

[56] References Cited

U.S. PATENT DOCUMENTS

| | | | |
|---|---|---|---|
| 2,914,936 | 12/1959 | Reinold | 52/396.1 X |
| 4,121,396 | 10/1978 | Oogami et al. | 52/235 |
| 4,873,806 | 10/1989 | Jeschke | 52/235 |
| 4,999,960 | 3/1991 | Herwegh et al. | 52/235 |
| 5,105,593 | 4/1992 | Kaminaga et al. | 52/235 |

FOREIGN PATENT DOCUMENTS

| | | | |
|---|---|---|---|
| 1014857 | 12/1964 | United Kingdom | 52/235 |

OTHER PUBLICATIONS

"Stripping Zips Up Curtain Wall" Engineering News--Record, p. 50, Apr. 1961.

*Primary Examiner*—Carl D. Friedman
*Assistant Examiner*—Laura A. Callo

[57] ABSTRACT

Cladding units for a building and a seal structure for the joints thereof are disclosed. A cladding unit comprises a cladding member comprised of a framework and a face member attached to one side face thereof and fastener stringers for a waterproof slide fastener attached one each to the outer lateral parts of the cladding member, the fastener stringers each comprising a waterproof tape and an engaging part provided with a multiplicity of coupling elements attached to the waterproof tape as spaced at fixed intervals along one longitudinal edge thereof, the end parts of the waterproof tapes of all adjoining fastener stringers being integrally joined, and the joined corner parts of the waterproof tapes protruding from the corner parts of the framework. The joint formed between the adjoining cladding units is sealed by coupling the engaging parts of the opposed fastener stringers of the cladding units. The gaps formed between the end parts of the fastener stringers are sealed by attaching the relevant waterproof sheets through the medium of an adhesive agent or by means of thermal welding to the joined corner parts of the waterproof tapes of the fastener stringers protruding from the corner parts of the frameworks of the cladding units.

11 Claims, 26 Drawing Sheets

CLADDING UNITS FOR BUILDING AND SEAL STRUCTURE FOR JOINT THEREOF

BACKGROUND OF THE INVENTION

1. Field of the Invention

This invention relates to cladding units or facing units for forming the outer wall of a building and a structure for sealing a joint between adjoining cladding units.

2. Description of the Prior Art

As one form of the outer wall of a building, the unit type curtain wall that is formed by joining curtain walls side by side vertically and laterally as attached to the skeleton frame of a building is known. Generally, the curtain wall units each comprise a framework, a panel or screen fitted to the framework, and a dry seal member fitted to the perimeter of the framework.

When the curtain wall units mentioned above are attached as vertically and laterally adjoined to one another to the skeleton frame of a given building, the seal members of these adjoining curtain wall units are pressed against one another and the joints consequently formed therebetween are sealed. It is, however, very difficult to press the seal members correctly against one another. Even when they are correctly pressed, the joints are not always sealed fully effectively. Usually, therefore, the joints between the adjoining curtain wall units are sealed by filling the joints with a wet sealing material. This work of filling the joints with the wet sealing material turns out to be very irksome.

SUMMARY OF THE INVENTION

It is, therefore, an object of the present invention to provide cladding units or facing units and a seal structure for the joints thereof which are liberated from the problems mentioned above.

In accordance with one aspect of the present invention, there is provided a cladding unit which comprises a cladding member comprised of a framework and a face member attached to one side face thereof and fastener stringers for a waterproof slide fastener attached one each to the outer lateral parts of the cladding member, the fastener stringers mentioned above each comprising a waterproof tape and an engaging part provided with a multiplicity of coupling elements attached to the waterproof tape as spaced at fixed intervals along one longitudinal edge thereof, the end parts of the waterproof tapes of all adjoining fastener stringers being integrally joined, and the joined corner parts of the waterproof tapes protruding from the corner parts of the framework. According to this structure, the joint between two adjoining cladding units can be infallibly sealed by uniting the opposed fastener stringers of the cladding units with a slider and the gap between the framework and each of the fastener strings can be sealed so securely as to prevent rainwater from leaking through the corner parts of the framework.

In a preferred mode of this aspect of the invention, the engaging part of the fastener stringers mentioned above is so formed that one end part thereof will protrude from one end part of the waterproof tape in the direction of length thereof. When the opposed fastener stringers of the adjoining cladding units are to be united, therefore, the insertion thereof into a slider is facilitated because the relevant engaging parts protruding on one end side thereof from the corresponding waterproof tapes can be drawn out from between the adjoining cladding units and inserted into the slide groove of the slider.

Another aspect of the present invention consists in providing a seal structure for the joint to be formed between the opposed frameworks of the cladding units mutually adjoined and attached to the backing member of the building.

In a basic mode of this aspect of the invention, the joint formed between the adjoining cladding units is sealed by coupling the engaging parts of the opposed fastener stringers of the cladding units. The gaps formed between the end parts of the fastener stringers, for example, at the cruciform joint due to the intersection of a lateral joint and a vertical joint and at the T-shaped joint due to the T-shaped adjoining of three cladding units are sealed by either attaching the relevant waterproof sheets through the medium of an adhesive agent or by means of thermal welding to the joined corner parts of the waterproof tapes of the fastener stringers protruding from the corner parts of the frameworks of the cladding units or by further filling the joined corner parts with a wet sealing material.

As another mode of the seal structure, a seal structure is provided which is capable of sealing the end-part joint between the end parts of a first and a second cladding unit which adjoin each other and a wall in an opening of a building with a wet sealing material. In one mode of this seal structure, the joint between the first and second cladding units is sealed by coupling the engaging parts of the opposed fastener stringers of the first and second cladding units. In the end part in which the joint between the first and second cladding units confronts the wall surface in the opening of the building, the end parts of a pair of opposed fastener stringers of the first and second cladding units are extended to the end parts of the waterproof tapes opposed to the wall of the building and joined integrally to the end parts of the waterproof tapes thereby connecting the waterproof tapes opposed to the wall of the building through the medium of the extended parts of the coupled fastener stringers. The waterproof tapes joined as described above and opposed to the wall of the building and the extended parts of the fastener stringers are bent so that the bent parts are opposed to the wall of the building. The gaps between the wall of the building and the bent parts of those of the waterproof tapes and the fastener stringers of the first and second cladding units that are opposed to the wall of the building are sealed by filling the gaps with the wet sealing material.

In another mode of the seal structure for the end-part joint, the waterproof tapes of the first and second cladding units which are opposed to the wall in the opening of the building are bent so that the bent parts of the waterproof tapes are opposed to the wall of the building. A waterproof sheet is disposed as tightly joined over the building wall side end parts of the waterproof tapes of the coupled fastener stringers and the opposed end parts of the bent waterproof tapes opposed to the wall of the building so as to cover the gap between the opposed end parts of the bent waterproof tapes. The gaps between the wall of the building and the waterproof sheet and tapes of the first and second cladding units opposed to the wall of the building are sealed by filling the gaps with the wet sealing material.

According to yet another mode of the present invention, a seal structure is provided which is capable of sealing the joint to be formed where an obstacle thrusts out from between the first and second cladding units arranged in an adjoining state with a wet sealing material. In this seal structure, depressed parts adapted jointly to conform to the contour of the obstacle are formed one each in the first and second cladding units thereby interrupting the continuity of the fastener stringers in the depressed parts. The waterproof tapes are attached to the surfaces of the depressed parts. The end parts of the waterproof tapes of the depressed parts are joined to the waterproof tapes of the opposed fastener stringers mentioned above. The waterproof tapes are bent such that the bent parts thereof are opposed to the obstacle. The engaging parts of the opposed fastener stringers attached to the first and second cladding units mentioned above are mutually coupled thereby sealing the joints on the opposite sides across the obstacle as the boundary. The gaps between the obstacle and the end parts of the coupled fastener stringers mentioned above and the gaps of the obstacle and the waterproof tapes of the depressed parts are sealed by filling the gaps with the wet sealing material.

BRIEF DESCRIPTION OF THE DRAWINGS

Other objects, features, and advantages of the invention will become apparent from the following description taken together with the drawings, in which.

DETAILED DESCRIPTION OF THE PREFERRED EMBODIMENTS

Figure 1:
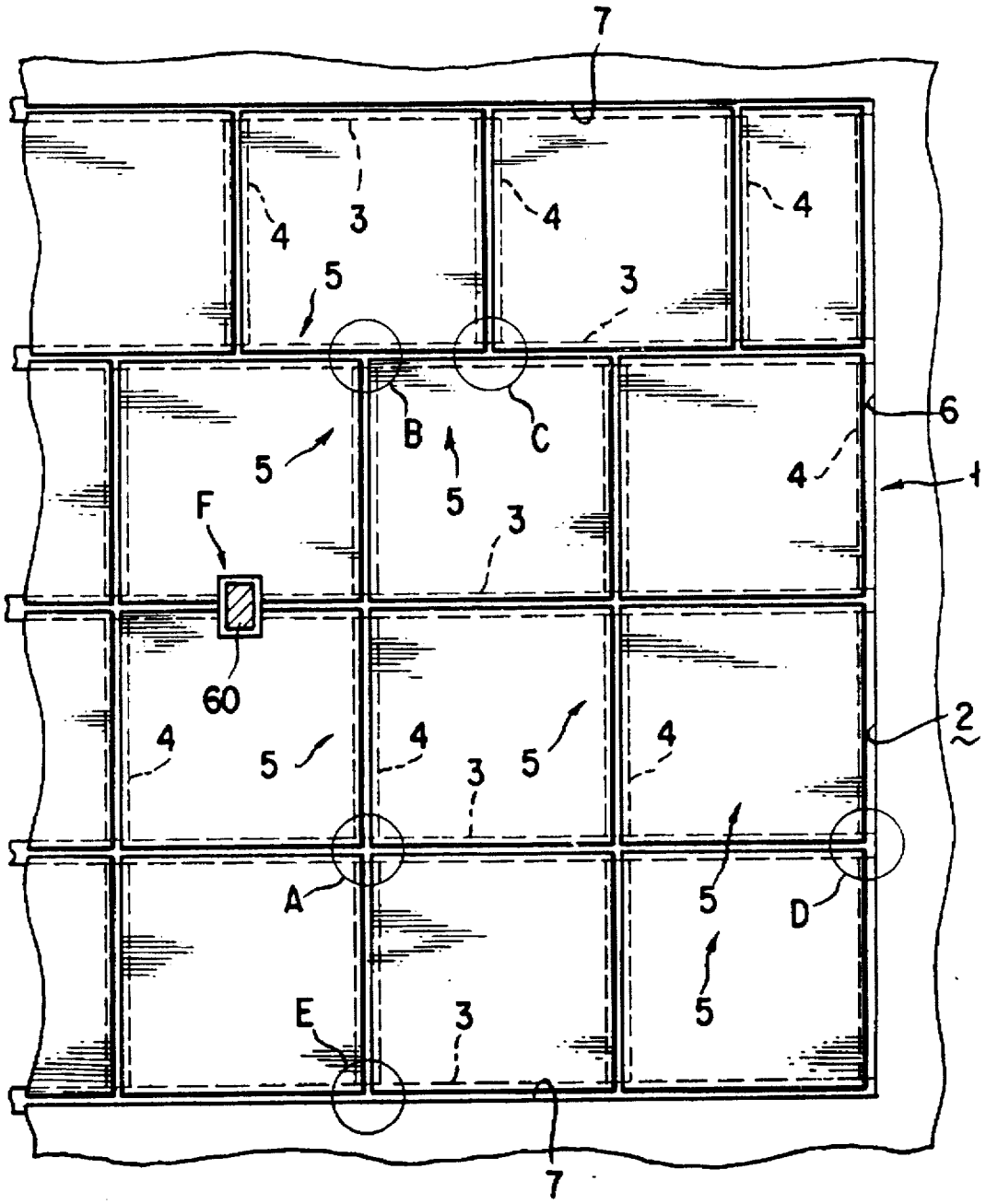
FIG. 1 is a schematic front view showing the state in which cladding units are fixed to the skeleton frame of a building.

A plurality of lateral backing members 3 made of steel and a plurality of vertical backing members 4 made of steel are fixed in an opening 2 in a skeleton frame of a building 1 and cladding units 5 are fixed to the outdoor sides of the upper and lower lateral backing members 3 and the left and right vertical backing members 4 as shown in FIG. 1. The end part joints between the cladding units 5 and vertical edge parts 6 and lateral edge parts 7 in the opening of the building and lateral joints and vertical joints between vertically and laterally adjoining cladding units 5 are severally sealed with a waterproof slide fastener and a waterproof sheet which will be specifically described hereinafter.

The cladding units 5 mentioned above, as shown in FIG. 2, each comprise a cladding member 15 consisting of a framework 13 formed by joining an upper frame member 10, a lower frame member 11, and laterally opposite vertical frame members 12 in the shape of a square and a face member 14 fixed to the outdoor side surface of the framework 13 and fastener stringers 16 attached to the frame members 10, 11, and 12. The fastener stringers 16 are severally paired with those of the cladding units 5 which are adjoined as opposed thereto and, consequently, are enabled to form waterproof slide fasteners in cooperation therewith.

Figure 2:
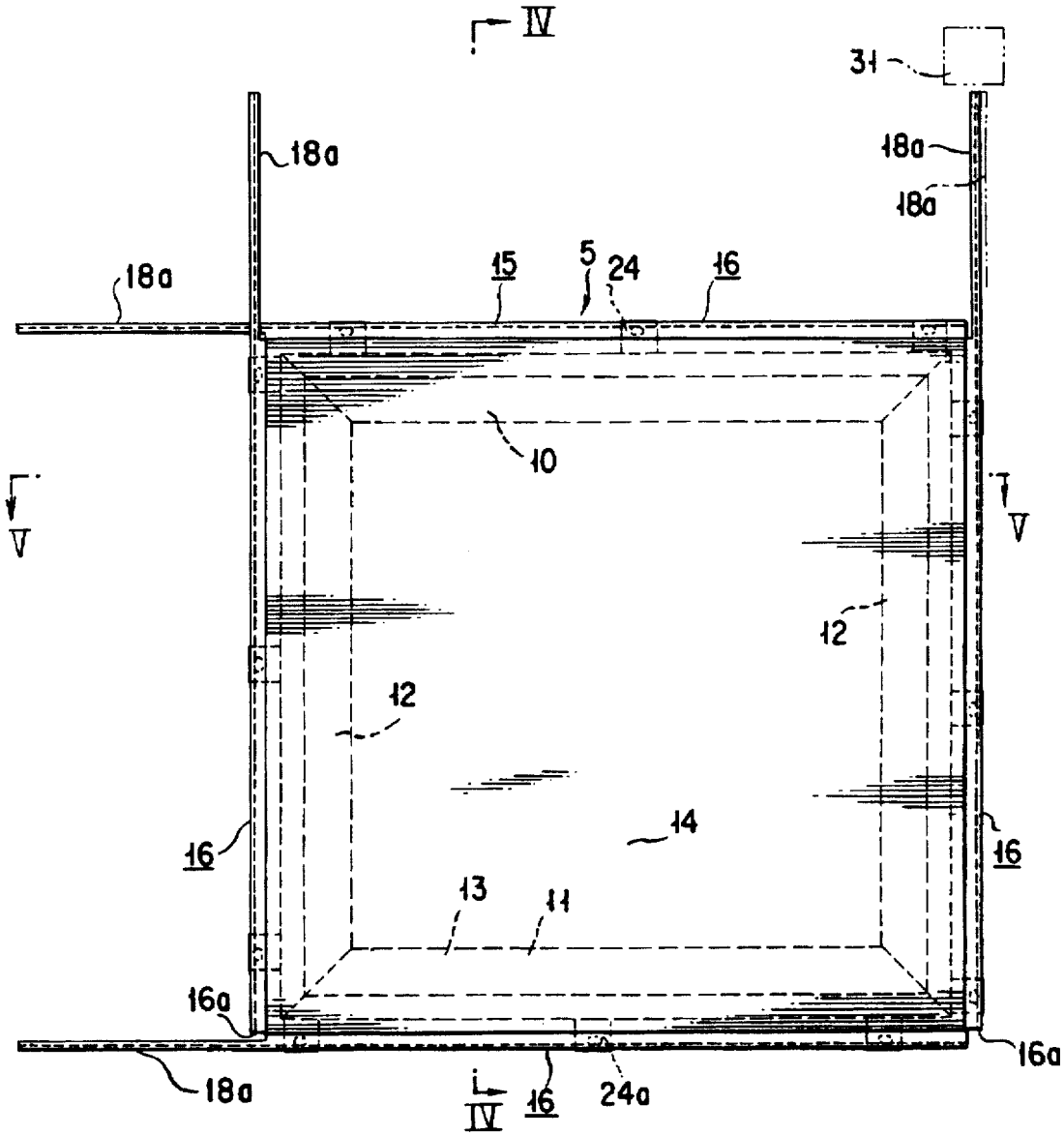
FIG. 2 is a front view of one of such cladding units.
Figure 3:
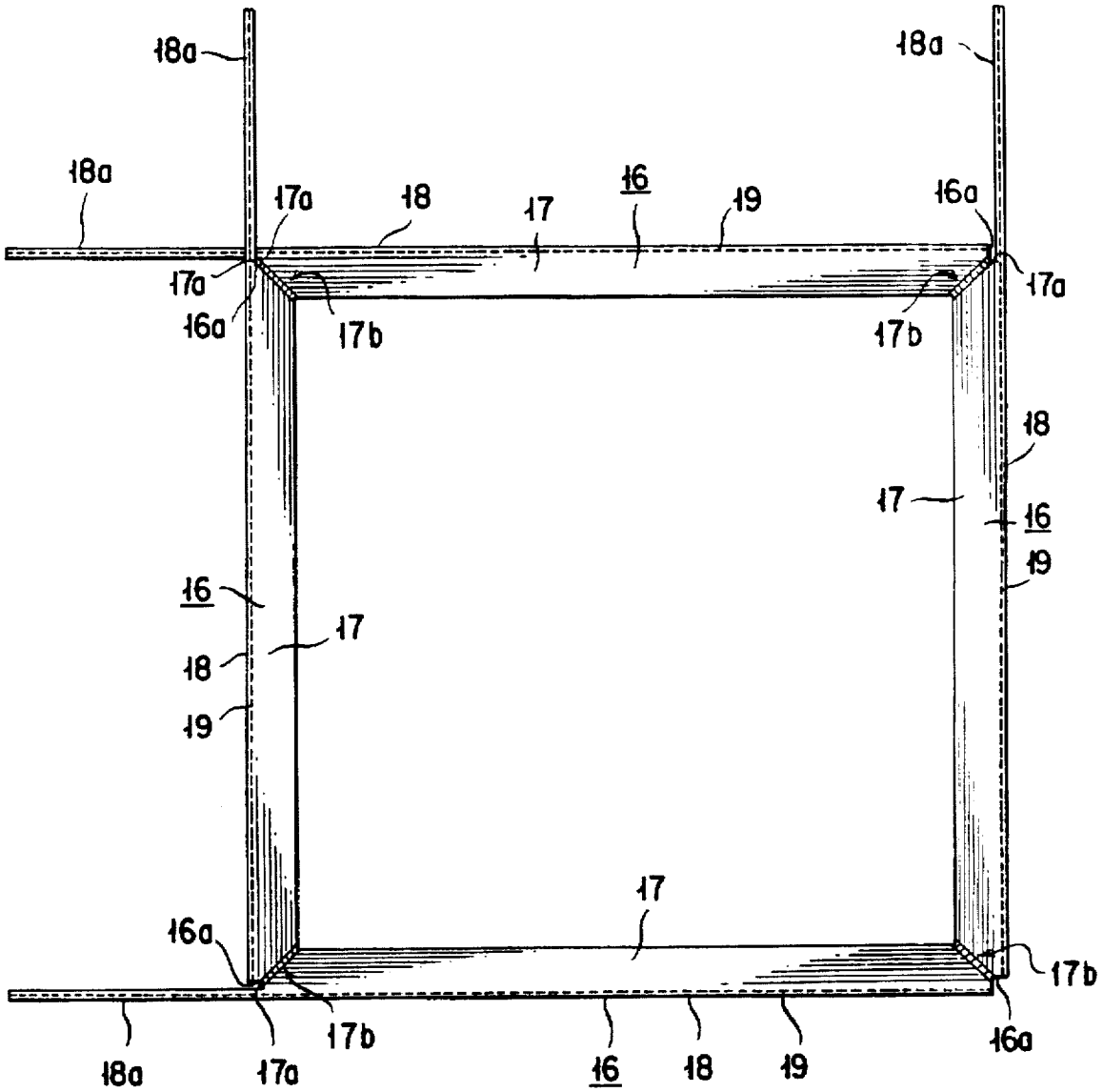
FIG. 3 is a front view of joined fastener stringers.

The fastener stringers 16 mentioned above, as shown in FIG. 3, each comprise a waterproof tape 17 and an engaging part 18 having a multiplicity of coupling elements 19 fixed to the waterproof tape 17 as regularly spaced along one longitudinal edge part thereof. One end part **18*a* of the engaging part 18 protrudes from one end part 17*a* of the waterproof tape 17 in the longitudinal direction thereof so as to permit easy insertion thereof into a slide groove of a slider 31, as shown in FIG. 2**.

The opposite end parts of each waterproof tape 17 are cut at an angle of 45 degrees and the end parts of the adjoining waterproof tapes 17 are opposed and joined by thermal welding. While four fastener stringers 16 are consequently joined in the shape of a square, notches **16*a* are formed one each in corner parts 17*b* of the joined fastener stringers 16 so as to prevent the relevant engaging parts 18 from continuing and allow extraction of a slider. Optionally, the end parts of the adjoining waterproof tapes 17** may be allowed to overlap and are joined to each other by means of thermal welding or an adhesive agent.

The substance of which the waterproof tape 17 is made is silicone rubber. The waterproof tape 17, therefore, excels in weatherability and durability and exhibits good fastness of adhesion to a waterproof sheet and the wet sealing material, a silicone sealant which will be specifically described hereinbelow.

In the embodiment described above, the face member 14 has been depicted as formed of a plate material. Optionally, it may be made of a glass material, a screen, or other materials.

Figure 4:
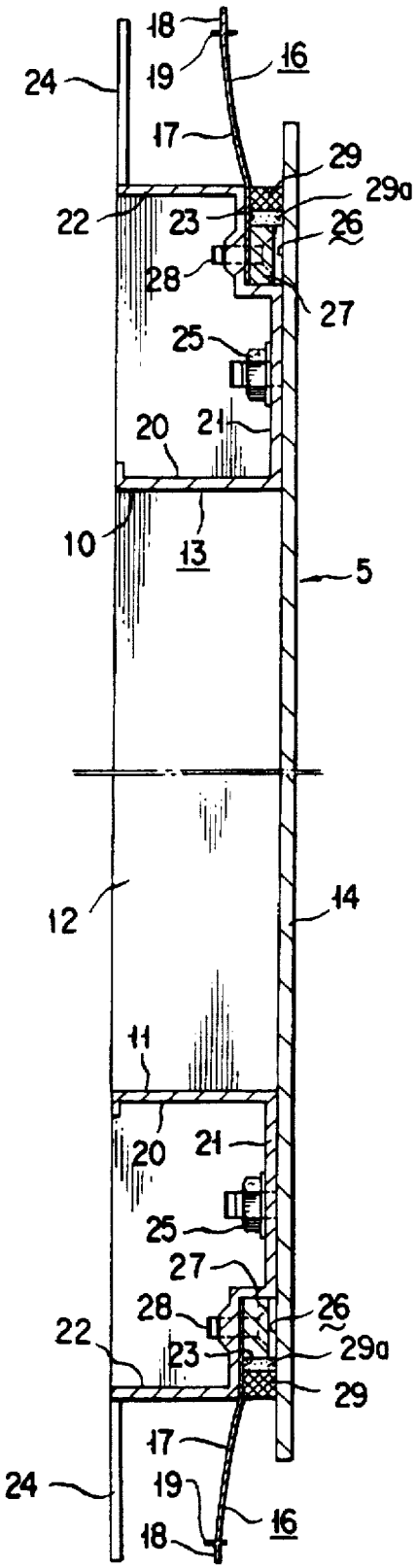
FIG. 4 and FIG. 5 are respectively a cross section taken through FIG. 2 along the line IV—IV and a cross section taken therethrough along the line V—V.
Figure 5:
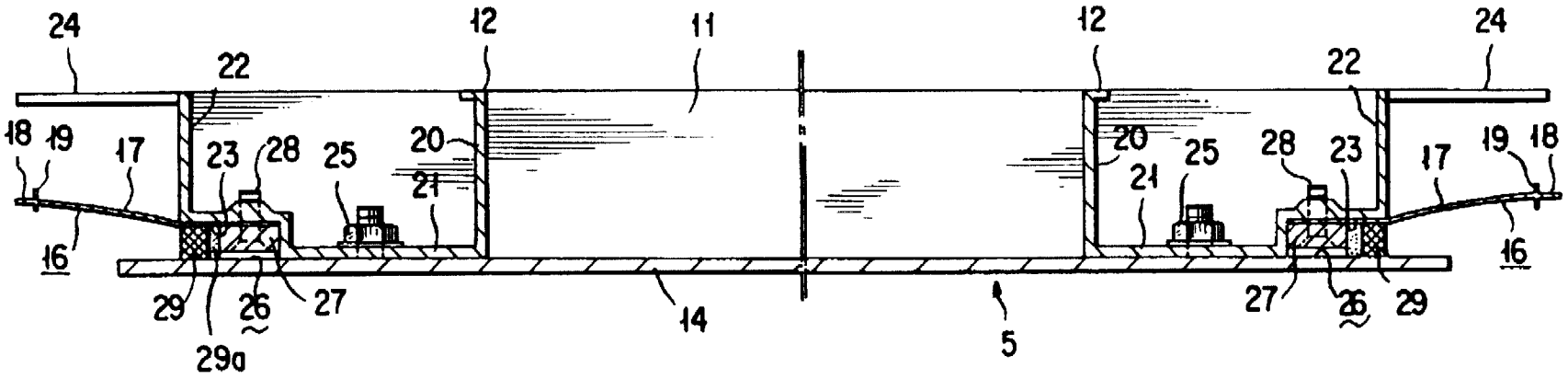

The frame members 10, 11, and 12 mentioned above, as shown in FIG. 4 and FIG. 5, each comprise an elongate inner wall part 20, an elongate outer wall part 22, and a connecting part 21 serving to connect the longitudinal edges of these wall parts, which are so joined as to form a cross section roughly in the shape of three sides of a square. The outer edge part of the connecting part 21 is bent in the shape of a crank to form a tape fixing part 23 along the outer wall part 22. In the other longitudinal edge of the outer wall part 22, a plurality of outwardly protruding fixing pieces 24 are integrally formed as spaced with prescribed intervals in the longitudinal direction thereof. To the connecting parts 21 of the frame members 10, 11, and 12, the face member is fixed with securing devices or fasteners 25. The rear side of the face member 14 is separated from the tape fixing part 23 to form a depressed part 26 therebetween. The fixing pieces 24 protrude outwardly from the pheripheral edges of the face member 14.

The end parts of the frame members 10, 11, and 12 are cut at an angle of 45 degrees and abutted and connected by welding or by means of a corner block or a connecting piece. The longitudinal edge part of each of the waterproof tapes 17 which form the fastener stringers 16 is secured to the tape fixing parts 23 with a securing device or fastener 28 through the medium of a retainer piece 27. The retainer pieces 27 and the securing devices 28 are disposed inside the depressed parts 26 and are covered with the face member 14 and therefore placed out of sight. The longitudinal edge part of each of the waterproof tapes 17 and the one end parts 18*a* of the engaging parts 18 protrude outwardly from the face member 14. The depressed parts 26 (the gaps between the face member 14 and the waterproof tapes 17) are each filled with a wet sealing material 29 such as silicone rubber through the medium of a backup member 29*a* formed of a plastic foam such as a hard polyurethane foam. Owing to the use of the wet sealing material 29 in this manner, the waterproof tapes 17 of the four squarely joined fastener stringers 16 are tightly secured to the framework 13 and the joined corner parts 17*b* of the adjoining waterproof tapes 17 are allowed to protrude outwardly from the corner parts of the framework 13.

The cladding unit 5 is assembled by fixing the four squarely joined fastener stringers 16 to the framework 13 and thereafter fixing the face member 14 thereto.

Figure 6:
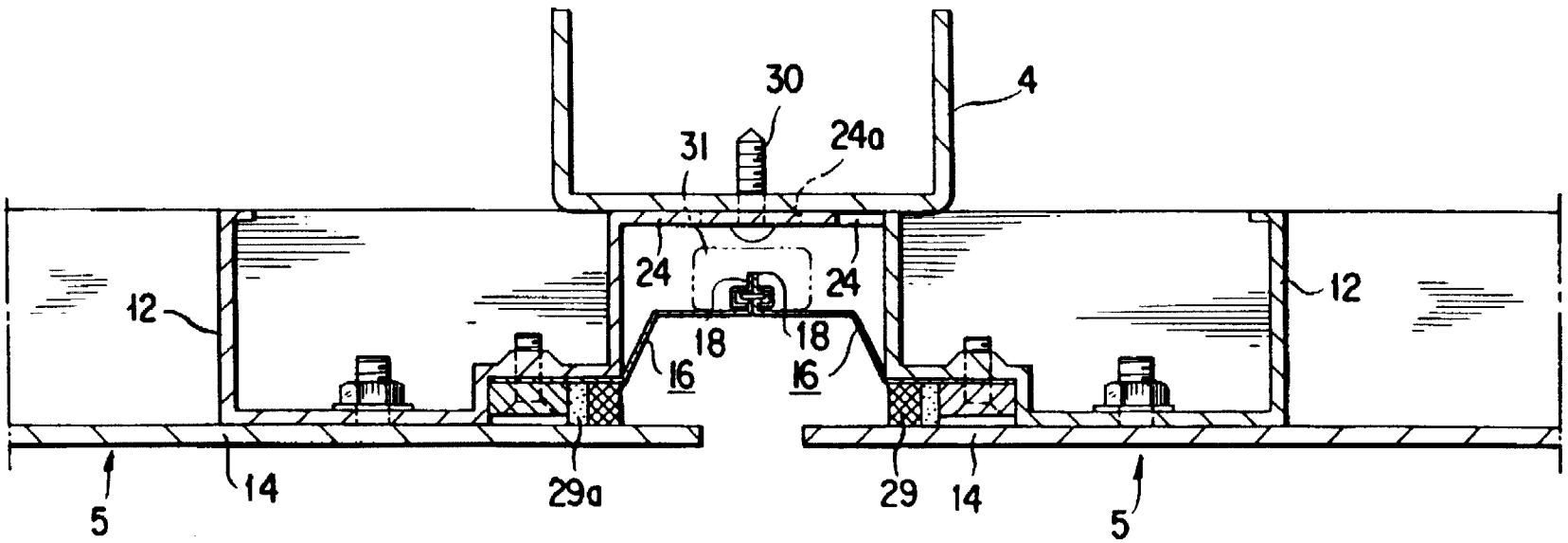
FIG. 6 is a cross-sectional view of a fixing part of the cladding units attached to a backing member of the skeleton frame of the building.

The cladding units 5 are assembled at a factory, for example, and then transported to a site for the fixation on a building. The fixing pieces 24 of the vertical frame members 12 of the laterally adjoining cladding units 5 are severally secured with a securing device or fastener 30 such as, for example, a screw to the vertical backing member 4 as shown in FIG. 6 and, at the same time, the fixing pieces 24 of the upper and lower frame members 10, 11 of the vertically adjoining cladding units 5 are severally secured with a securing device such as, for example, a screw to the lateral backing member 3. The fixing pieces 24 each have an oblong hole 24*a* formed therein (see FIG. 2 and FIG. 6). Since the oblong holes 24*a* are so adapted that the securing device 30 may be inserted therethrough, the cladding units 5 are allowed to move in the direction of plane.

In the state in which the laterally adjoining cladding units 5 are fixed to the lateral backing members 3 and the vertical backing members 4 of the skeleton frame of the building 1, the engaging parts 18 of the fastener stringers 16 attached to the vertical frame members 12 are opposed to each other. The outwardly projecting one-end parts 18*a* of the paired engaging parts 18 are drawn out from between the laterally adjoining cladding units 5 and are inserted in a slider 31 as indicated by an imaginary line in FIG. 2. The slider 31 is moved in the direction of length of the paired engaging parts 18 to mesh the coupling elements 19 of the engaging parts 18 of the paired fastener stringers 16. Then, the slider 31 is extracted through the notch 16*a* in the other end part of the paired fastener stringers 16.

Since the waterproof tapes 17 of the pair of the fastener stringers 16 are airtightly and watertightly coupled as a result of the procedure described above, the vertical joint between the laterally adjoining cladding units 5 can be sealed infallibly. Since the slider 31 is engaged with the engaging parts 18 on the outer side than between the laterally adjoining cladding units 5, the work of coupling of the fastener stringers is easy to perform.

Since the lateral joint between the vertically adjoining cladding units 5 is sealed in the same manner as described above, it can be sealed infallibly.

The outwardly projecting one-end parts of the engaging parts 18 of the fastener stringers 16 may be either cut off or left per se after they have been coupled by means of the slider 31. In the illustrated embodiments, they are depicted in a cut state.

Now, the seal structure for the cruciform joint (the part indicated by A in FIG. 1) formed by the vertically and laterally adjoining cladding units 5 will be described below.

Figure 7:
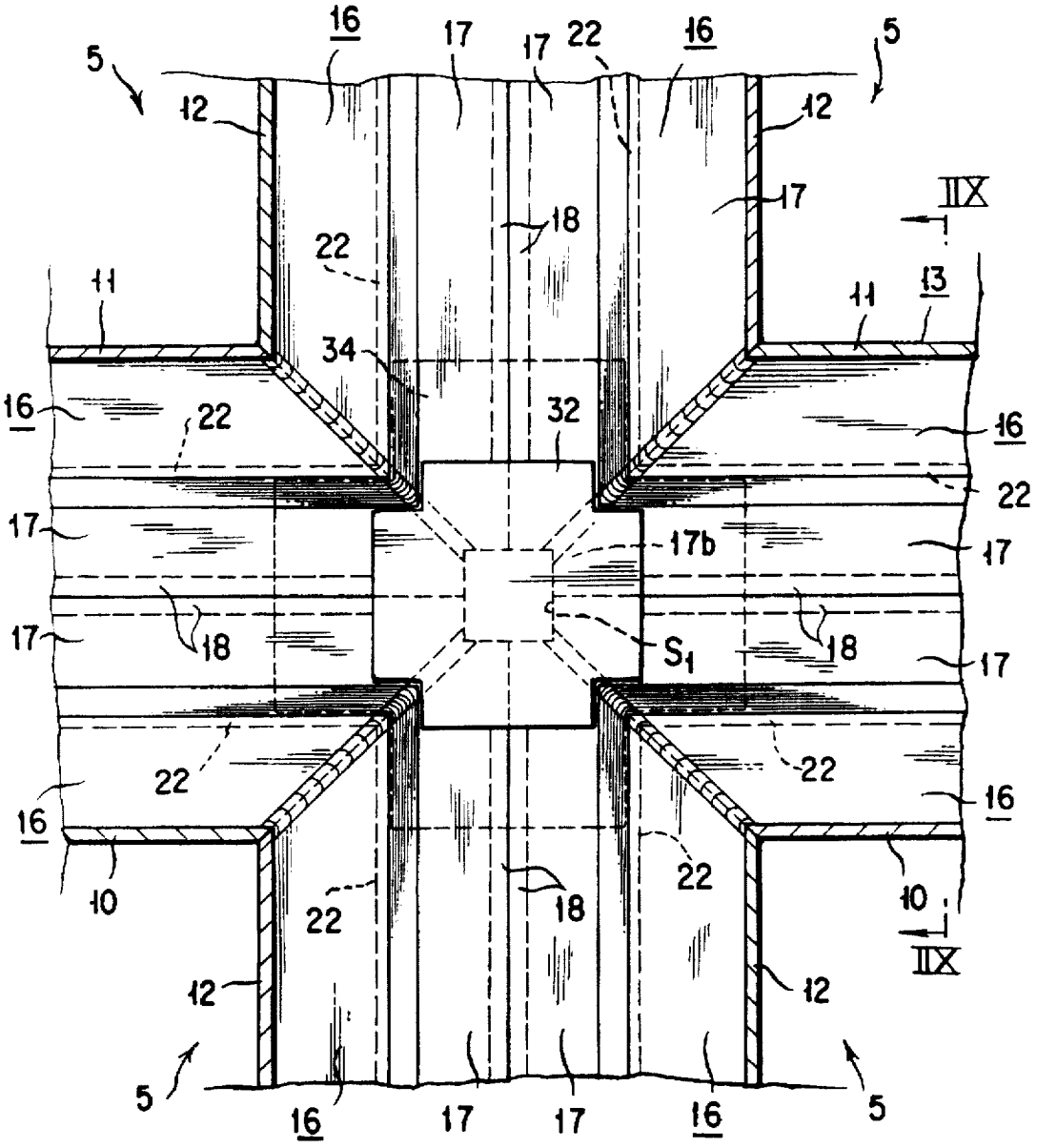
FIG. 7 is a fragmentary longitudinal section of a cruciform joint among cladding units.

Since the fastener stringers 16 have their continuity interrupted in the part of the cruciform joint resulting from the intersection of the lateral joint and the vertical joint as shown in FIG. 7, an opening $S_1$ of the shape of a square occurs in the part mentioned above.

Figure 8:
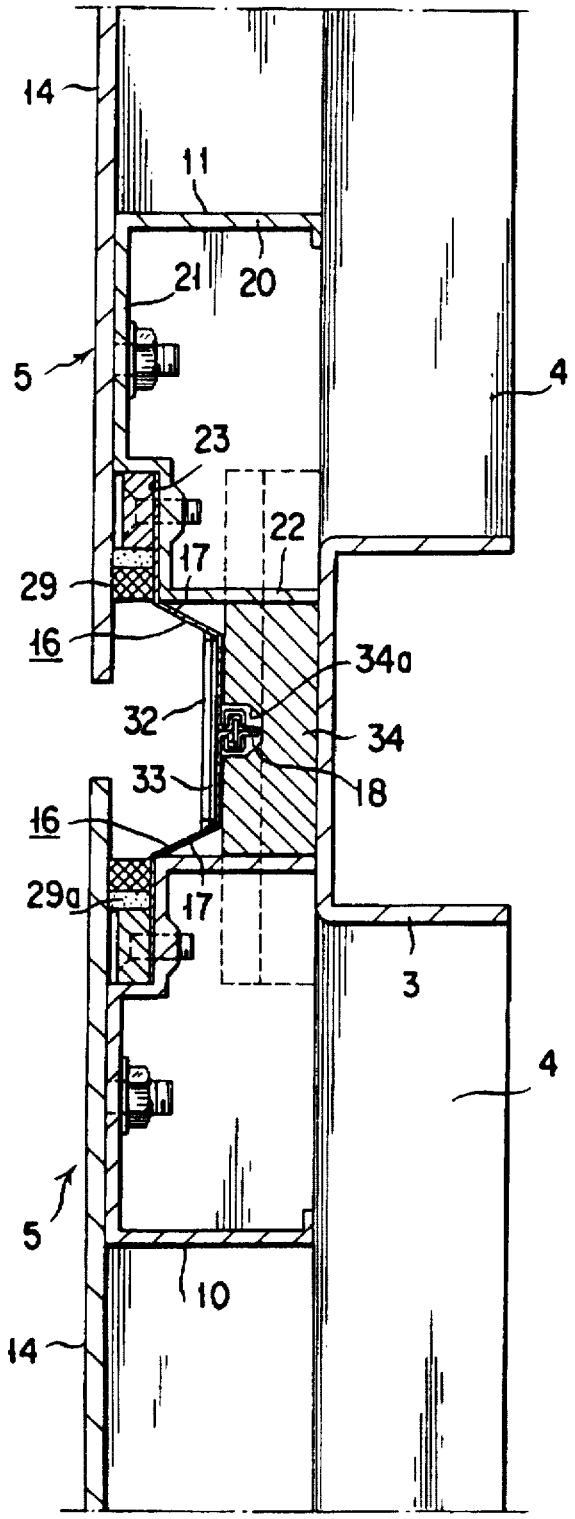
FIG. 8 is a cross section taken through FIG. 7 along the line IIX—IIX.

The opening $S_1$ mentioned above, therefore, is closed by joining a cruciform waterproof sheet 32 with an adhesive agent 33 to the joined corner parts 17*b* of the waterproof tapes 17 of the fastener stringers 16 protruding from the corner parts of the framework 13 in the part of the cruciform joint as shown in FIG. 7 and FIG. 8 so that the part of the cruciform joint is sealed by continuing the joined corner parts 17*b* of the waterproof tapes 17 of the fastener stringers 16 through the medium of the waterproof sheet 32. This sheet 32 may be joined to the joined corner parts 17*b* of the waterproof tapes 17 by means of thermal welding.

The waterproof sheet 32 is made of a material such as silicone resin which excels in weatherability and durability and manifests fast adhesiveness to the waterproof tapes 17. It is appropriate to adopt an adhesive agent 33 using a silicone basis.

When the waterproof sheet 32 is to be joined by adhesion as described above, it is difficult to implement this adhesion by depressing the sheet 32 with strong force against the waterproof tapes 17 because the waterproof tapes 17 are separated from the lateral backing members 3 and the vertical backing members 4. The present seal structure, therefore, attains this adhesion infallibly by fixing a cruciform receiving block 34 to the lateral backing members 3 and the vertical backing members 4 and thereby causing this receiving block 34 to support the waterproof tapes 17 and allow the sheets 32 to be depressed with strong force against the waterproof tapes 17, as shown in FIG. 7 and FIG. 8. This receiving block 34 is provided with a cruciform groove 34*a* for admitting the engaging parts 18.

Optionally, the seal aimed at may be obtained by filling the opening $S_1$ with a wet sealing material such as silicone rubber instead of the adhesion of the waterproof sheet 32.

Next, the seal structure for the T-shaped joint (the part indicated by B in FIG. 1) to be formed among three cladding units 5 in such a manner that one of the cladding units 5 will adjoin astraddle to the other two cladding units 5', 5" disposed as adjoined to each other will be described below.

Figure 9:
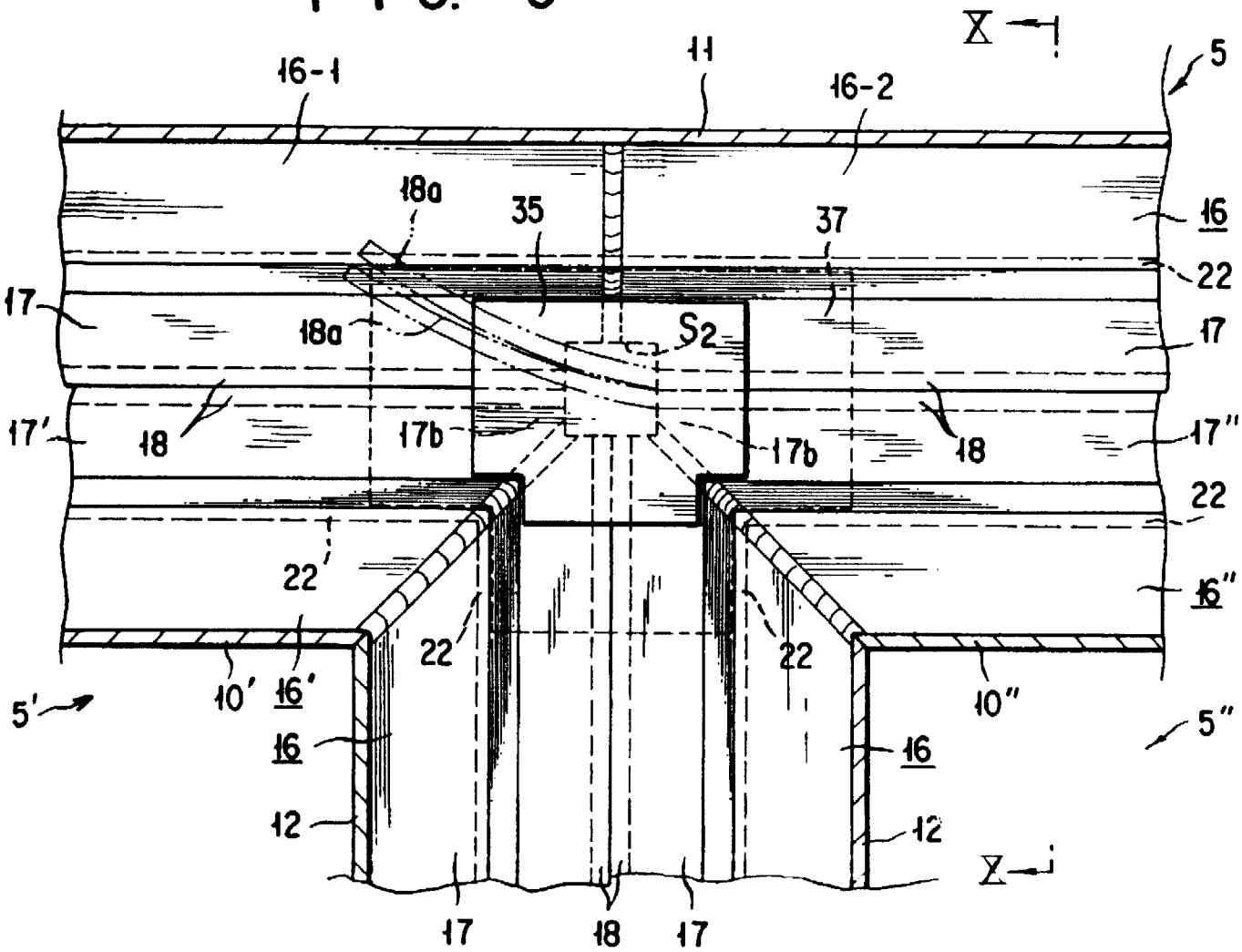
FIG. 9 is a fragmentary longitudinal section of a T-shaped joint among cladding units.

The laterally opposite fastener stringers 16', 16" attached to the upper frame members 10', 10" of the laterally adjoining cladding units 5', 5" are severally coupled with the fastener stringer 16 attached to the lower frame member 11 of the upper cladding unit 5 as shown in FIG. 9. Since a gap occurs between the end parts of the laterally opposite fastener stringers 16', 16", however, the fastener stringers 16', 16" have the continuity thereof interrupted in the part of the T-shaped joint resulting from the intersection of the lateral joint and the vertical joint and consequently give rise to an opening $S_2$ of the shape of a square in the part mentioned above.

Figure 10:
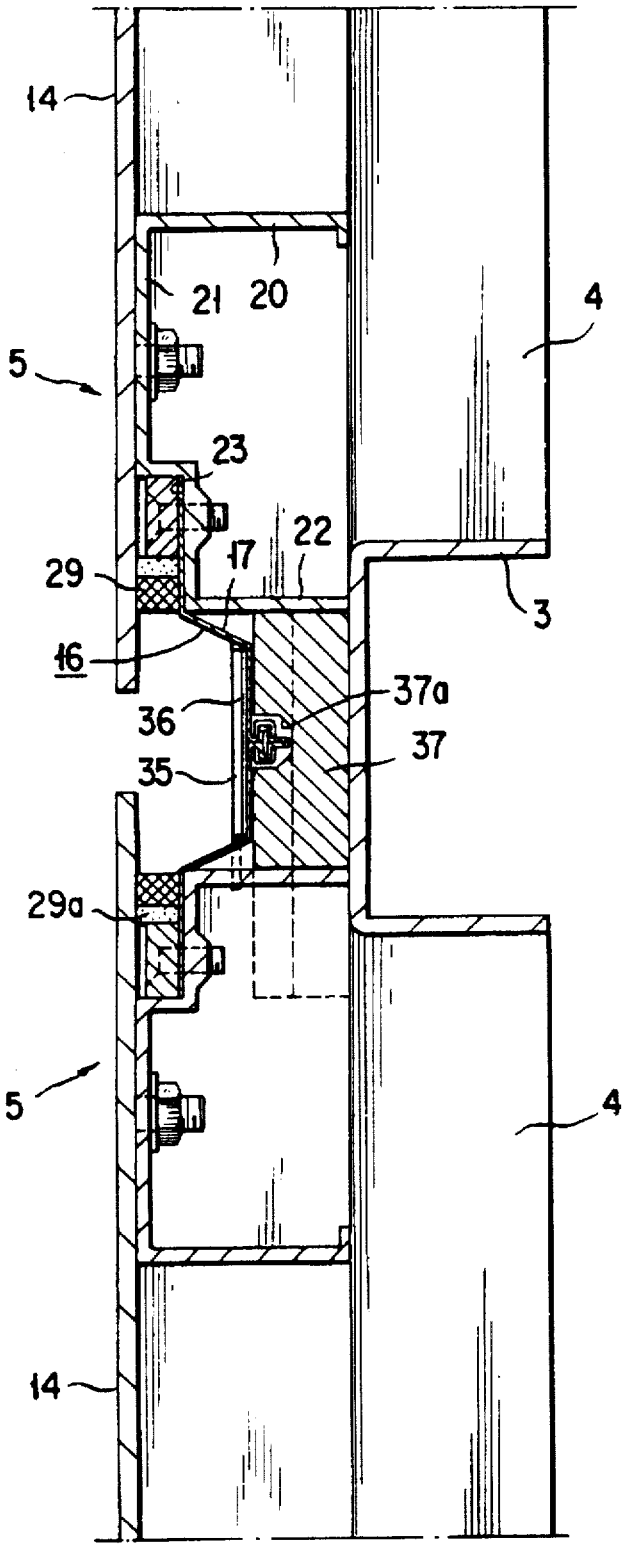
FIG. 10 is a cross section taken through FIG. 9 along the line X—X.

The opening $S_2$ mentioned above, therefore, is closed by joining a generally T-shaped waterproof sheet 35 with an adhesive agent 36 to all the joined corner parts **17*b* of the waterproof tapes 17', 17" of the laterally opposite fastener stringers 16', 16" and the waterproof tape 17 of the upper fastener stringer 16 in the part of the T-shaped joint as shown in FIG. 9 and FIG. 10 and, at the same time, the part of the T-shaped joint is sealed by continuing the fastener stringers 16, 16', and 16" through the medium of the sheet 35**.

In this case, as in the case of sealing the part of the cruciform joint mentioned above, a T-shaped receiving block 37 is disposed on the intersection of the lateral backing members 3 and the vertical blocking members 4 so that the waterproof sheet 35 will be infallibly joined to the waterproof tapes 17, 17', and 17" by being depressed with strong force against the waterproof tapes 17, 17', and 17". This receiving block 37 likewise has a groove **37*a*** incised in the surface thereof.

The fastener stringers 16', 16" of the lower laterally adjoining cladding units 5', 5" are severally coupled with the opposite one fastener stringer 16 attached to the lower frame member 11 of the upper cladding unit 5 on the opposite longitudinal edge portions relative to the medial portion as the boundary as shown in FIG. 9. The fastener stringer 16 attached to the lower frame member 11 of the upper cladding unit 5 mentioned above is, therefore, divided into a first fastener stringer 16-1 and a second fastener stringer 16-2 as shown in FIG. 9, the separated end parts of the waterproof tape 17 are joined by thermal welding, and an edge of the thermally welded part is partly notched to permit removal of the slider. The one-end parts of the engaging parts 18 of the second fastener stringer 16-2 and the lower fastener stringer 16" connected thereto are formed so as to protrude from the waterproof tapes 17 in the longitudinal direction thereof as indicated by an imaginary line in FIG. 9.

In such an arrangement, the lower left fastener stringer 16' attached to the upper frame member 10' of the left cladding unit 5' and the upper first fastener stringer 16-1 attached to the lower frame member 11 of the upper cladding unit 5 are coupled with each other by engaging the slider with the left end parts respectively of these fastener stringers and moving the slider along the joint length of these fastener stringers. This slider is removed in the opening $S_2$ in the T-shaped joint. The lower right fastener stringer 16" attached to the upper frame member 10" of the right cladding unit 5" and the upper second fastener stringer 16-2 are coupled with each other by engaging the slider with the medial end parts positioned in the part of the T-shaped joint (the one-end parts **18*a* of the longitudinal engaging parts 18) respectively of these fastener stringers and moving the slider along the joint length of the fastener stringers. Thus, the engagement of the slider with fastener stringers is easily performed. Optionally, the one-end parts 18*a* of the engaging parts 18 may be kept from protruding from the waterproof tapes 18** in their longitudinal direction.

The T-shaped joint formed by the lower cladding unit 5 and the laterally paired upper cladding units 5 indicated by C in FIG. 1 is sealed in the same manner as described above. The seal aimed at may be attained by filling the opening $S_2$ with a wet sealing material instead of the adhesion of the waterproof sheet 35.

Now, the seal structure for the end part joint to be formed between the vertically adjoining cladding units 5 and the vertical edge part 6 of the wall in the opening of the building (the part indicated by D in FIG. 1) will be described below.

First, the end part structure of the lateral joint between the vertically adjoining cladding units on the side of the wall in the opening of the building will be explained.

Figure 11:
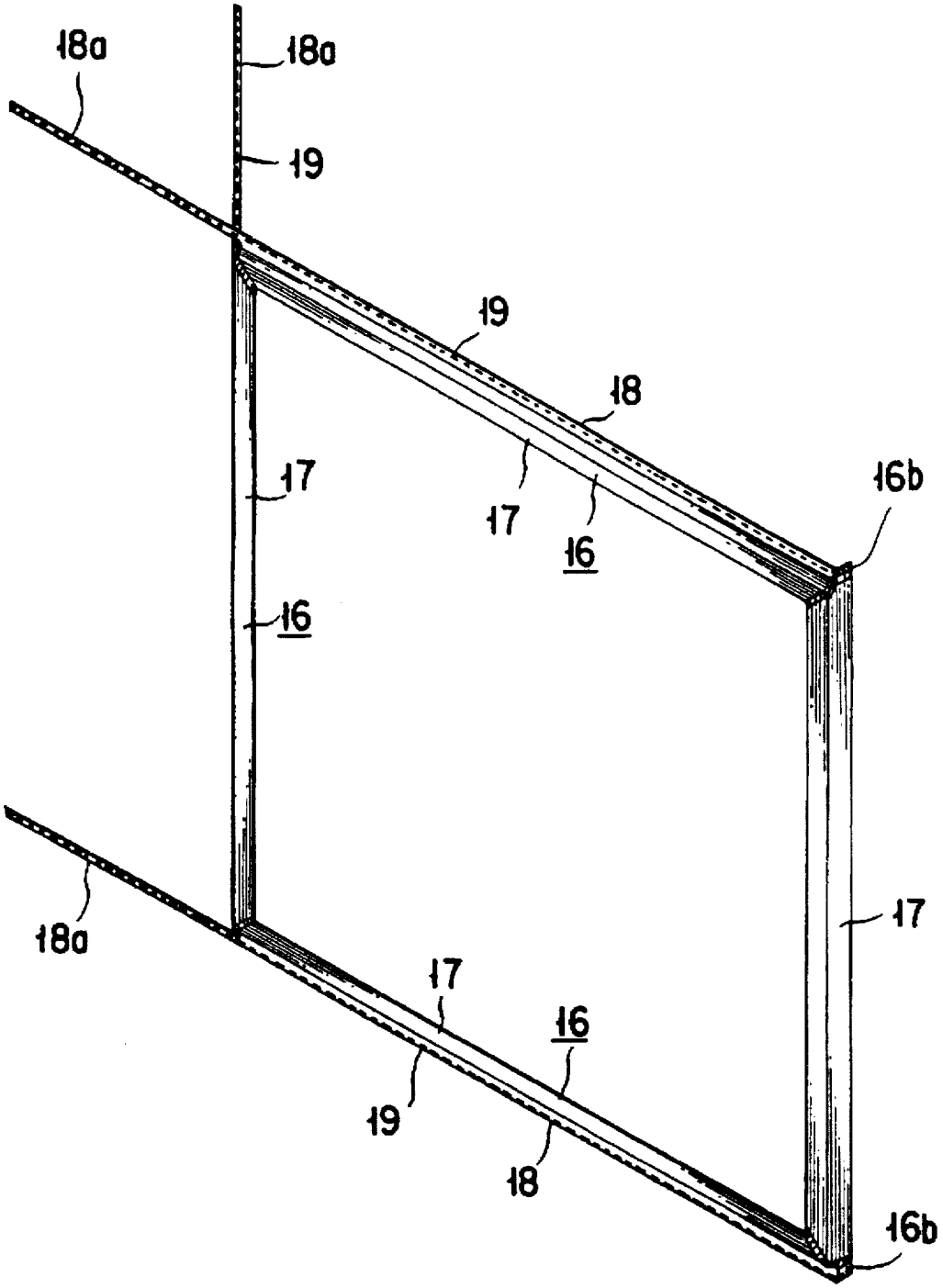
FIG. 11 is a perspective view of the joined fastener stringers for a cladding unit adjoining an edge part of the wall in the opening of the building.

The end parts **16*b* on the wall side of the building of the upper and lower fastener stringers 16 attached to the cladding unit 5 opposed to the vertical edge part 6 of the wall in the opening of the building 1 are bent as shown in FIG. 11. The longitudinal edge of the vertical waterproof tape 17 opposed to the vertical edge part 6 of the wall in the opening of the building 1 is bent and consequently brought into contact with the outer wall part 22 of the vertical frame member 12 and the upper and lower end parts thereof are joined to the end parts 16*b* of the upper and lower fastener stringers 16 mentioned above by thermal welding or adhesion. In the embodiment shown in FIG. 11, the waterproof tapes 17 are exclusively attached to the vertical frame members of the cladding units 5 opposed to the vertical edge part 6 of the wall in the opening of the building 1. The fastener stringers provided with an engaging part 18 may be used in the place of the waterproof tapes 17**.

Figure 12:
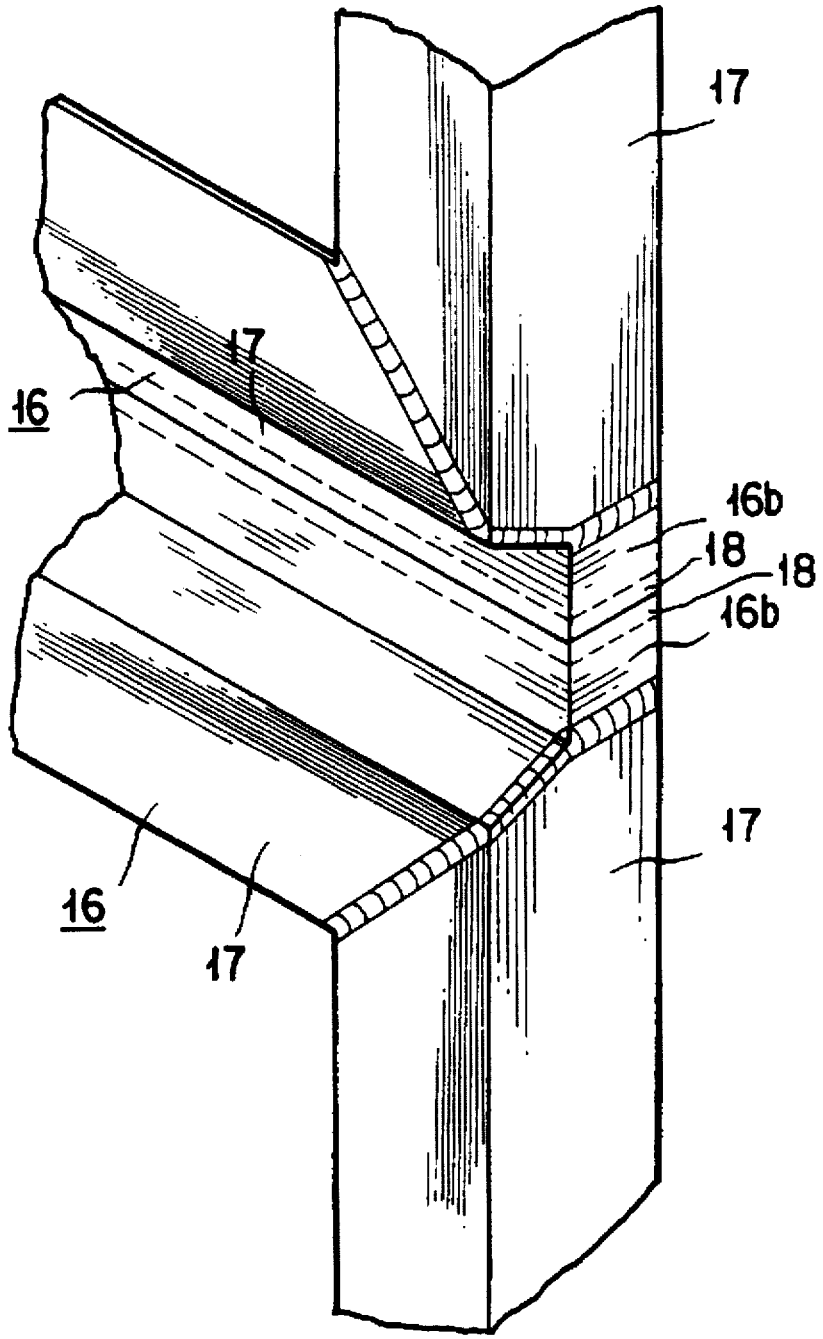
FIG. 12 is a fragmentary perspective view showing the state of coupling the upper and the lower fastener stringer of the adjoining cladding units adjoining the edge part of the wall in the opening of the building.

Owing to the structure described above, the waterproof tapes 17 are continued in the vertical direction in the longitudinal edges thereof opposed to the vertical edge parts 6 of the wall in the opening of the building 1 and, at the same time, continued also to the fastener stringers 16 in the part of the lateral joint through the medium of the end parts **16*b* thereof as shown in FIG. 12 when the upper fastener stringers 16 attached to the lower frame member 11 of the upper one of the vertically adjoining cladding units 5 and the lower fastener stronger 16 attached to the upper frame member 10 of the lower cladding unit 5** are coupled with the slider as mentioned above.

Figure 13:
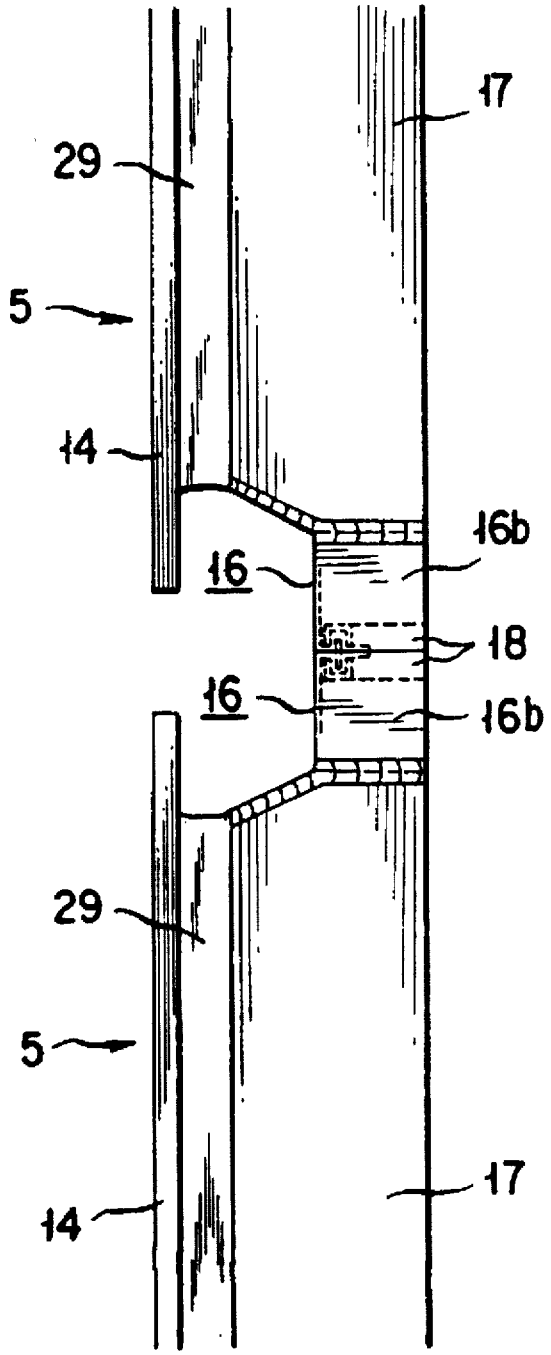
FIG. 13 is a fragmentary side view showing the state of coupling vertically adjoining cladding units along the edge part of the wall in the opening of the building.

As a result, the upper and lower fastener stringers 16 which serve to seal the lateral joint between the vertically adjoining cladding units 5 are continued as far as the one-side end parts thereof and, at the same time, the waterproof tapes 17 thereof are continued to the vertical waterproof tapes 17 of the upper and lower cladding units 5 and the waterproof tapes 17 are attached as continued to the one-side parts of the vertically adjoining cladding units throughout the entire length thereof as shown in FIG. 13.

Now, the seal structure for the gap between the upper and lower cladding units and the lateral edges of the wall in the opening of the building will be described below.

Figure 14:
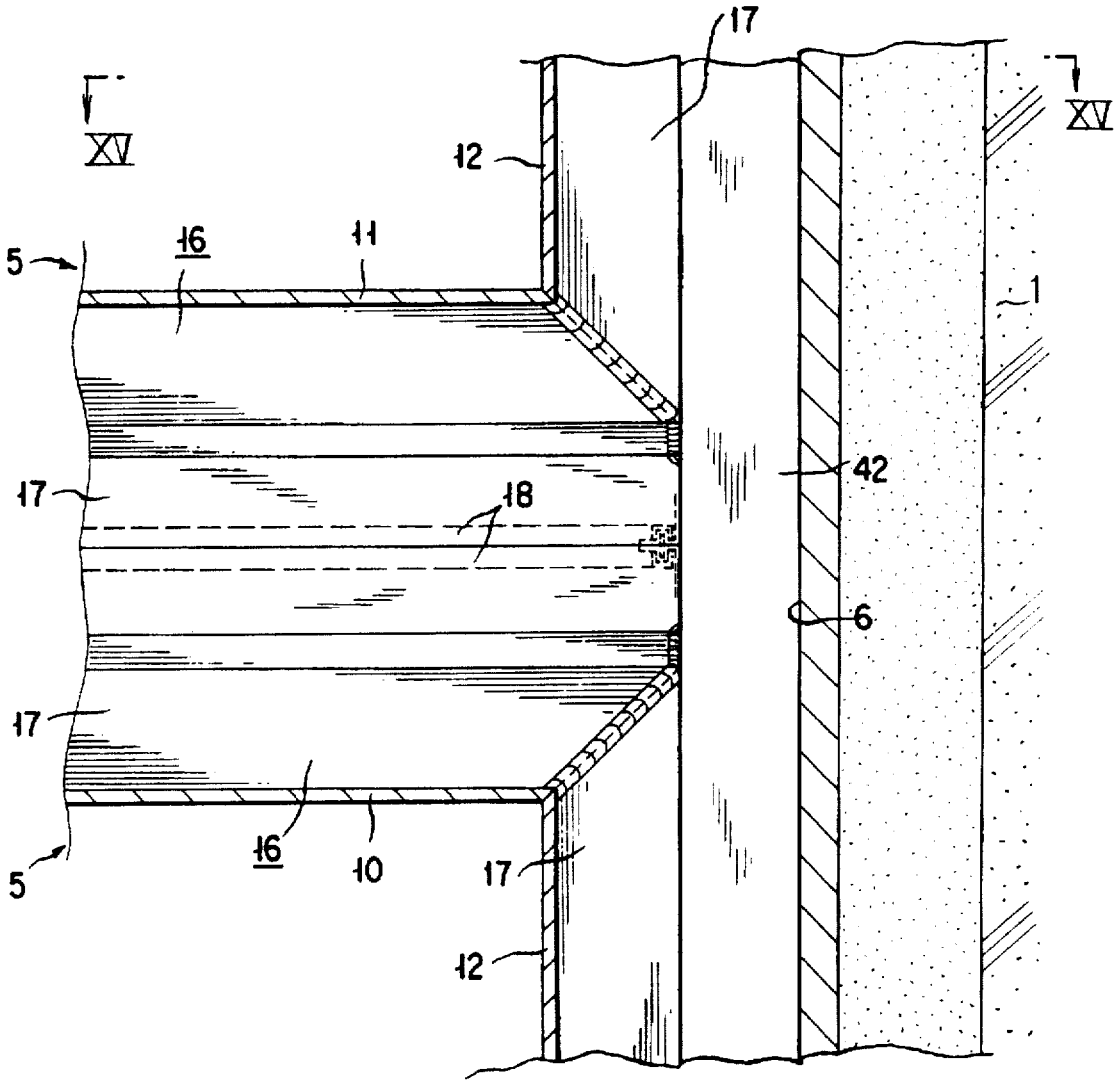
FIG. 14 is a fragmentary longitudinal section of an end part joint of vertically adjoining cladding units along the edge part of the wall in the opening of the building.
Figure 15:
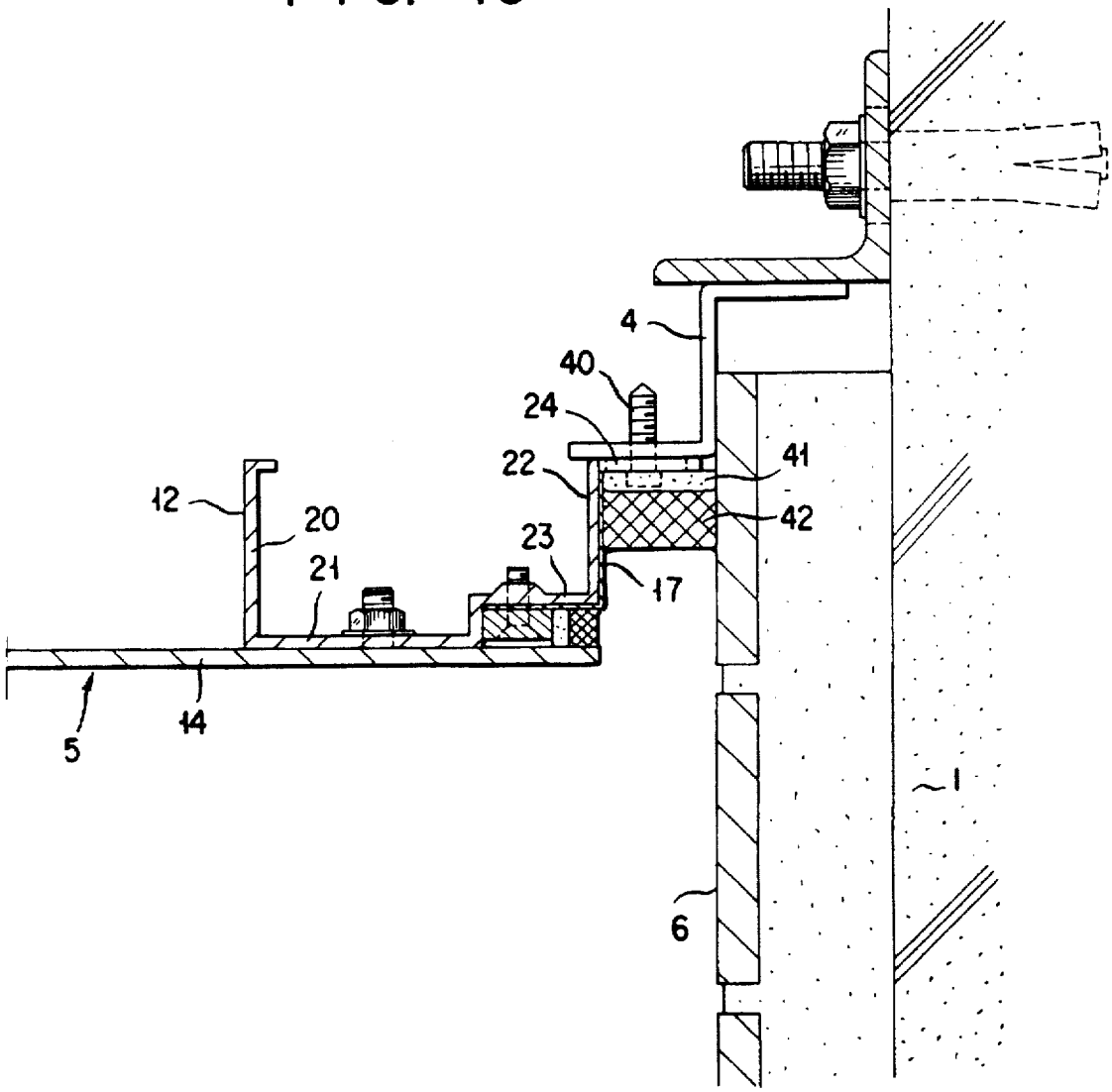
FIG. 15 is a cross section taken through FIG. 14 along the line XV—XV.

The seal aimed at is accomplished by fixing the fixing pieces 24 of one of the vertical frame members 12 with a securing device or a fastener 40 to the vertical backing member 4 attached to the end part of the skeleton frame in the opening of the building 1 and filling the vertical joints formed between the vertical edge part 6 of the wall and the vertical backing member 4 of the skeleton frame of the building 1 and one of the vertical frame members 12 with a wet sealing material 42 through the medium of a backup member 41 disposed on the fixing piece 24 along the vertical edge part 6 of the wall throughout the upper and lower cladding units 5 as shown in FIG. 14 and FIG. 15.

Now, the second embodiment of the seal structure for the end part joint mentioned above will be described below.

Figure 16:
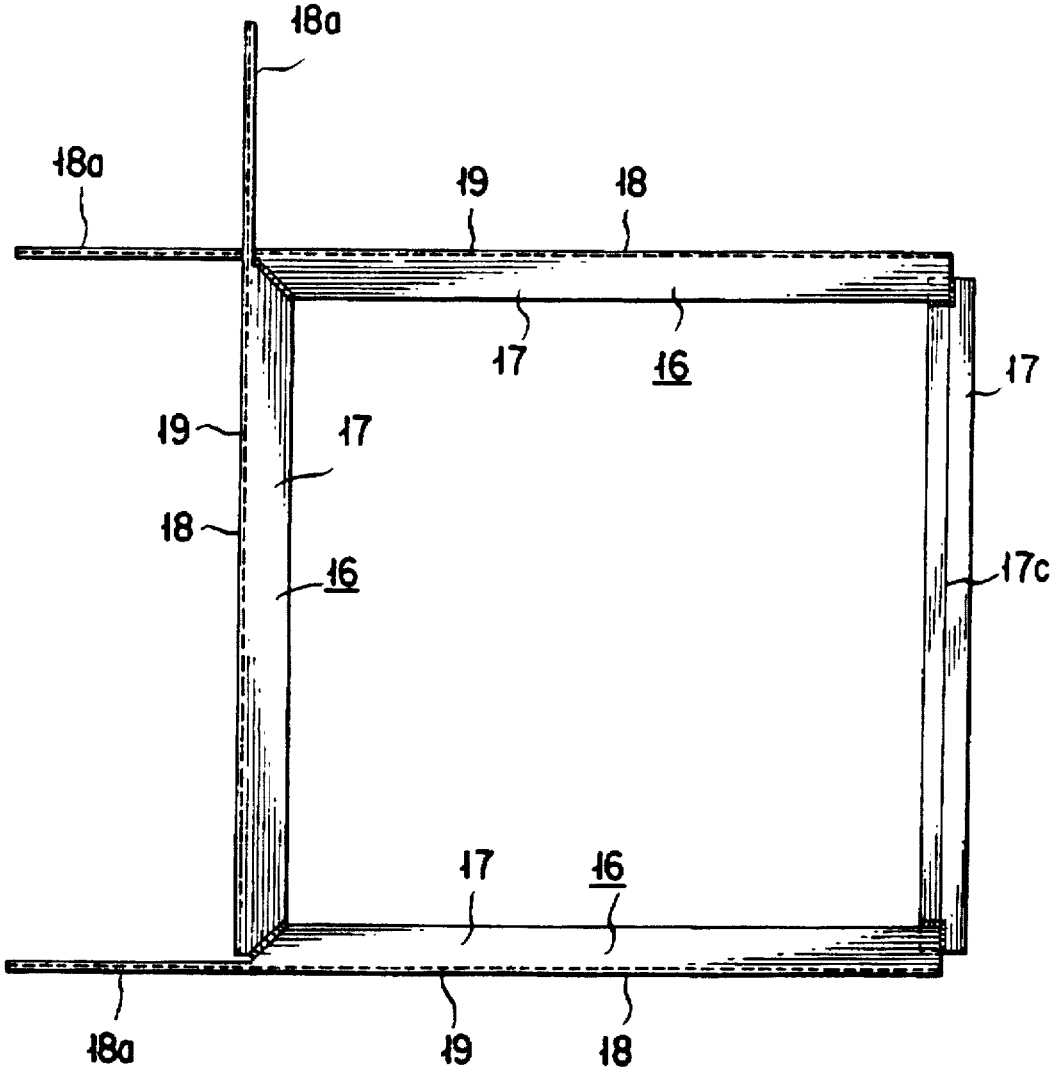
FIG. 16 is a front view of another embodiment of the joined fastener stringers for a cladding unit adjoining the edge part of the wall in the opening of the building.
Figure 17:
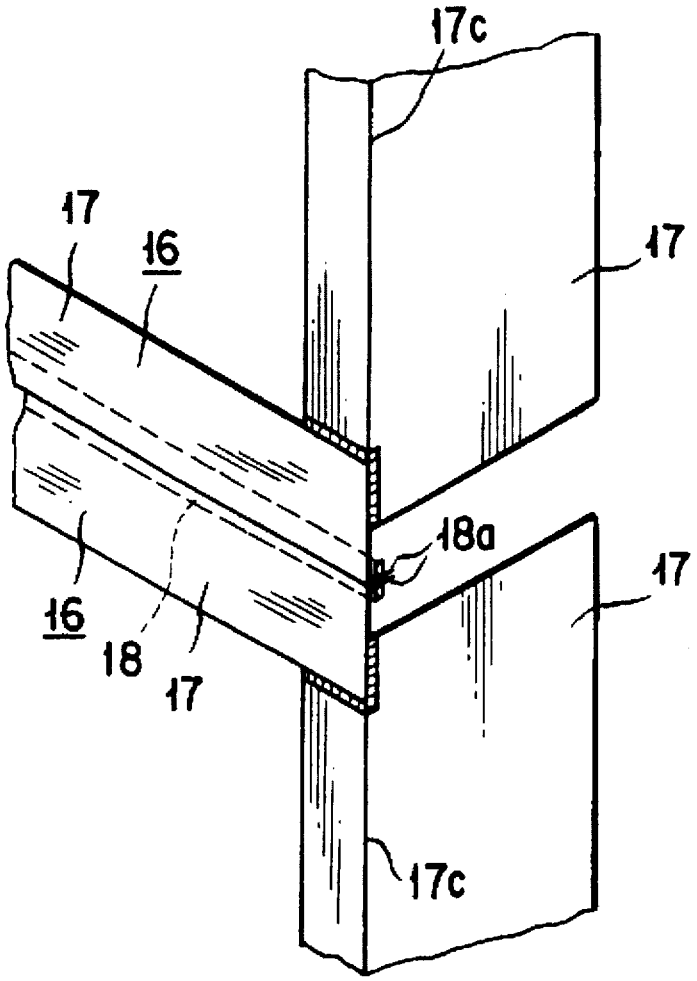
FIG. 17 is a fragmentary perspective view of the state of coupling the upper and the lower fastener stringer of the adjoining cladding units adjoining the edge part of the wall in the opening of the building.

The one-end parts of the upper and lower fastener stringers 16 are given a length for reaching the bending line 17*c* of the vertical waterproof tape 17 as shown in FIG. 16. In the state in which the opposed upper and lower fastener stringers 16 of the upper and lower cladding units 5 are mutually coupled, the waterproof tapes 17 of the coupled fastener stringers 16 and the upper and lower end parts of the vertical waterproof tapes 17 of the upper and lower cladding units 5 are deprived of their continuity as shown in FIG. 17.

Figure 18:
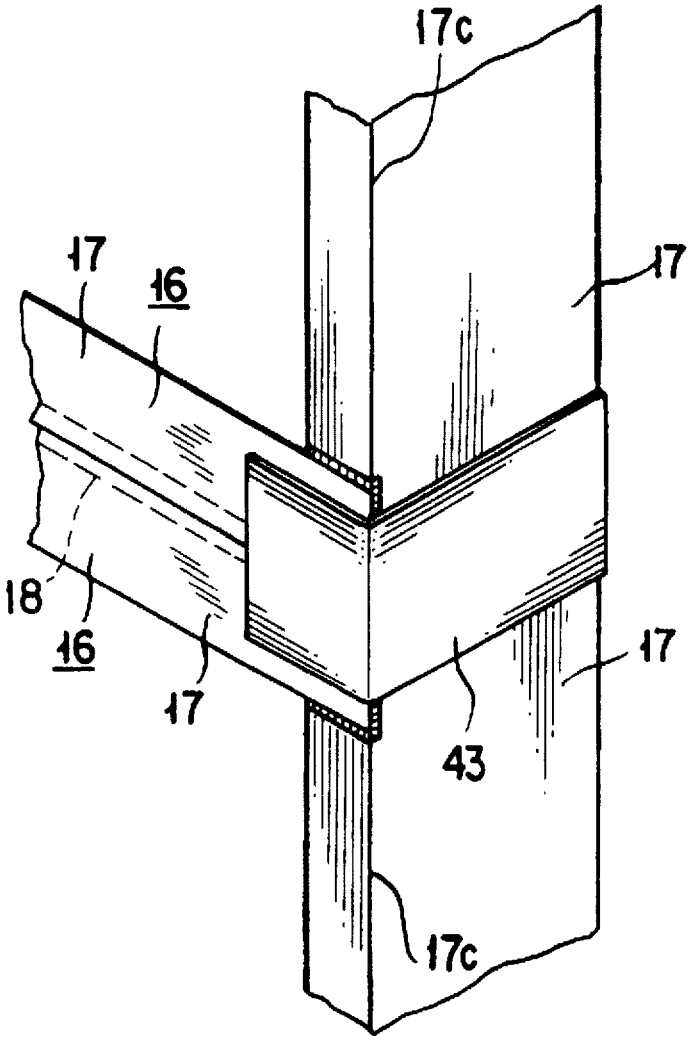
FIG. 18 is a fragmentary perspective view of the state of adhesion of a waterproof sheet to the end parts of the upper and lower waterproof tapes joined to the coupled fastener stringers as shown in FIG. 17.

Then, as shown in FIG. 18, a waterproof sheet 43 is joined by thermal welding or with an adhesive agent to the end parts of the waterproof tapes 17 of the coupled fastener stringers 16 and the vertical waterproof tapes 17 of the upper and lower cladding units 5 to establish continuity between the vertical waterproof tapes 17 of the vertically adjoining cladding units 5 and the waterproof tapes 17 of the coupled fastener stringers 16 serving to seal the lateral joint and the gap formed with the longitudinal edge parts 6 of the wall in the opening of the building 1 is filled with the wet sealing material.

Incidentally, the end part joint which is formed between the lateral edge part 7 of the wall in the opening of the building 1 and the laterally adjoining cladding units 5 as indicated by E in FIG. 1 is sealed in the same manner as described above.

Now, the structure for sealing the joint to be formed between the adjoining cladding units 5 and an obstacle 50 such as the post for an arcade, which is indicated by F in FIG. 1, will be described below on the assumption that the obstacle 50 thrusts from between the adjoining cladding units 5.

Figure 19:
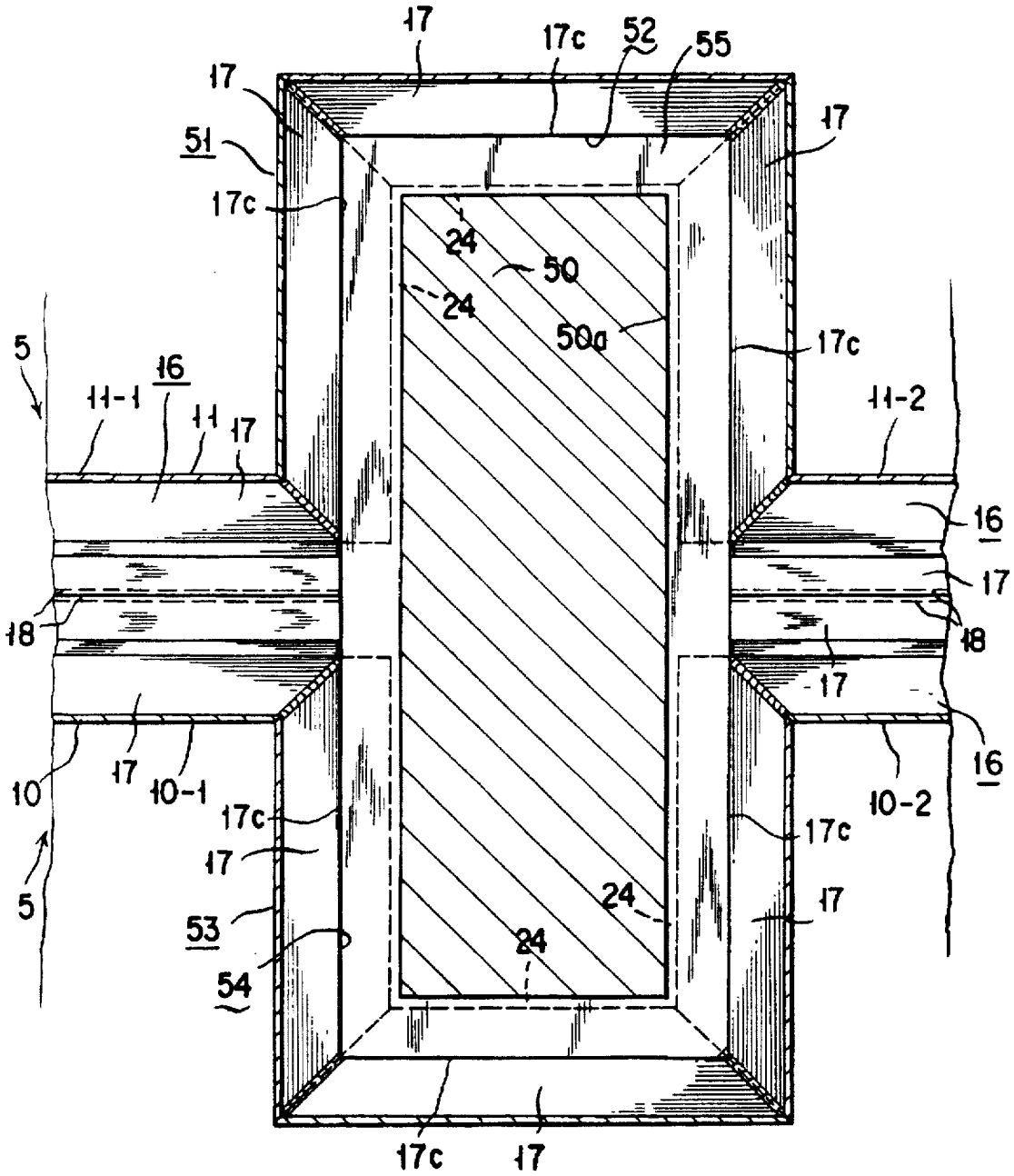
FIG. 19 is a fragmentary longitudinal section of a joint along the periphery of an obstacle.

The lower frame member 11 of the upper cladding unit 5 is divided by the obstacle 50 as a boundary into a first and a second frame member, 11-1 and 11-2, as shown in FIG. 19 and the first and the second frame member, 11-1 and 11-2, are connected through the medium of an auxiliary frame member 51 of the shape of three sides of a square to give rise to a depressed part 52 generally conforming to the cross section of the upper half of the obstacle 50.

The auxiliary frame member 51 is obtained by connecting three frame members having the same cross-sectional shape as the lower frame member 11 end to end in the shape of three sides of a square with a lower open side. One edge part of the waterproof tape 17 in the same shape of three sides of a square is attached to the auxiliary frame member 51 and the other edge part of the waterproof tape 17 is belt along the bent line 17*c* and joined to the bent end parts of the waterproof tapes 17 of the fastener stringers 16 attached to the first and second frame members 11-1 and 11-2 by thermal welding or adhesion.

The upper frame member 10 of the lower cladding unit 5 is also divided by the obstacle 50 as a boundary into a first and a second frame member, 10-1 and 10-2, in the same manner as above, and the first and the second frame member, 10-1 and 10-2, are connected through the medium of an auxiliary frame member 53 of the shape of three sides of a square to give rise to a depressed part 54 generally conforming to the cross section of the lower half of the obstacle 50.

The auxiliary frame member 53 is also obtained by connecting three frame members having the same cross-sectional shape as the upper frame member 10 end to end in the shape of three sides of a square with an upper open side. One edge part of the waterproof tape 17 in the same shape of three sides of a square is attached to the auxiliary frame member 53 and the other edge part of the waterproof tape 17 is bent along the bent line 17*c* and joined to the bent end parts of the waterproof tapes 17 of the fastener stringers 16 attached to the first and second frame members 10-1 and 10-2 by thermal welding or adhesion.

Owing to the structure described above, when the engaging parts 18 of the vertically adjoining lateral fastener stringers 16 are mutually coupled, the vertical waterproof tapes 17 attached to the upper auxiliary frame member 51 and the vertical waterproof tape 17 attached to the lower auxiliary frame member 53 are connected to the end parts of the waterproof tapes 17 of the coupled lateral fastener stringers 16 in the same manner as the seal structure for the end part joint mentioned above (FIG. 13).

Then, the gap between an outer surface 50*a* of the obstacle 50 opposed to the depressed parts 52, 54 of the upper and lower cladding units 5 and the waterproof tapes 17 is sealed by filling the gap with a wet sealing material 55 through the medium of a backup member. Incidentally, the fixing pieces 24 are integrally provided for the component frame members of the upper and lower auxiliary frame members 51, 53 as connected in the direction of length of the edge parts thereof. The fixing pieces 24 serve as receiving means for the backup member. Alternatively, platelike receiving members may be fixed to the outer surface 50*a* of the obstacle 50 or to the lateral backing member 3 and the vertical backing member 4.

Now, an embodiment of the cladding unit 5 using the face member 14 made of glass will be described below.

Figure 20:
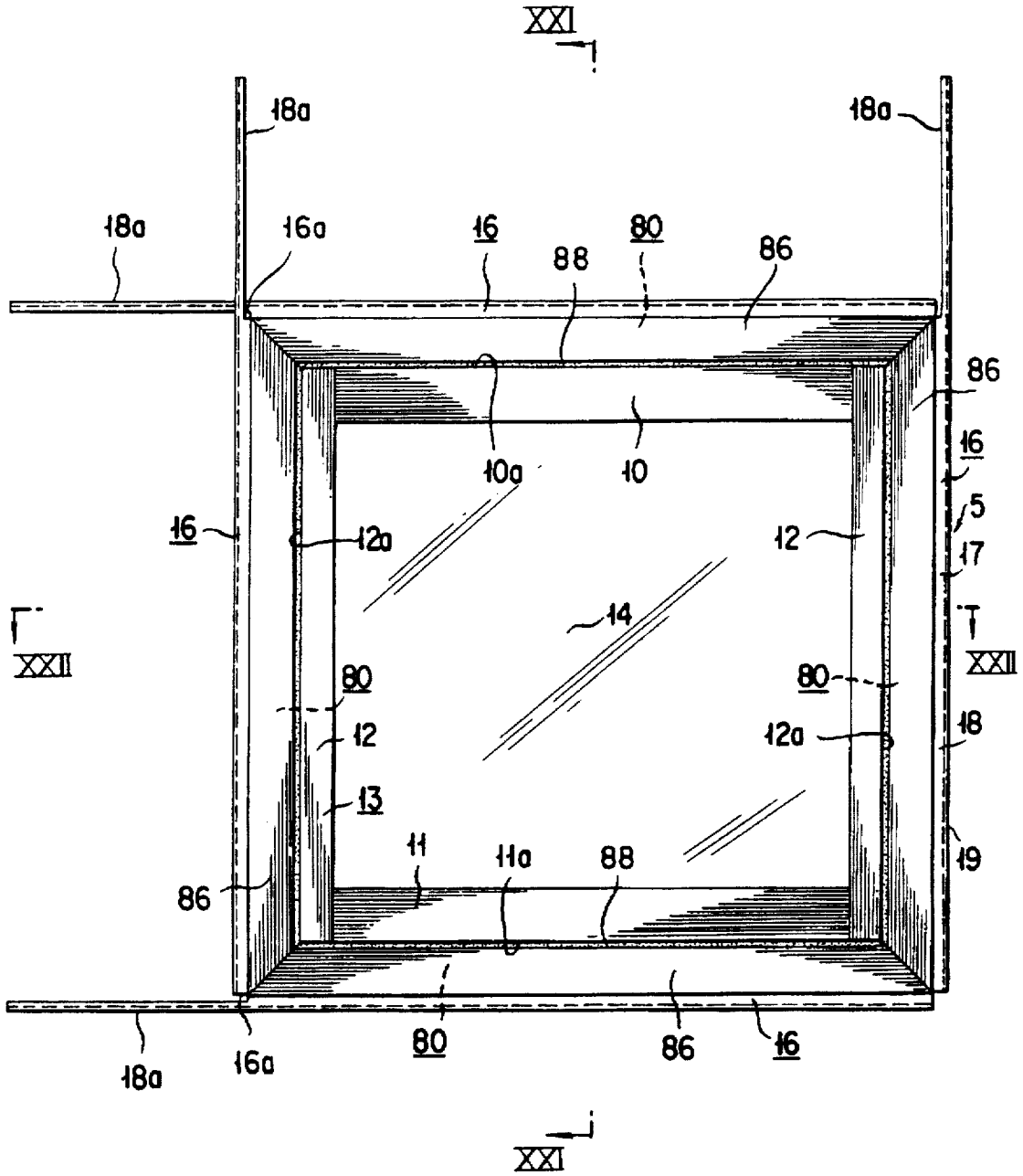
FIG. 20 is a front view of a cladding unit having a glass plate as a face member.

The framework 13 is formed, as shown in FIG. 20, by abutting and connecting the opposite ends of the upper frame member 10 to the upper parts of the left and right vertical frame members 12 and the opposite ends of the lower frame member 11 to the lower parts of the left and right vertical frame members 12.

Figure 21:
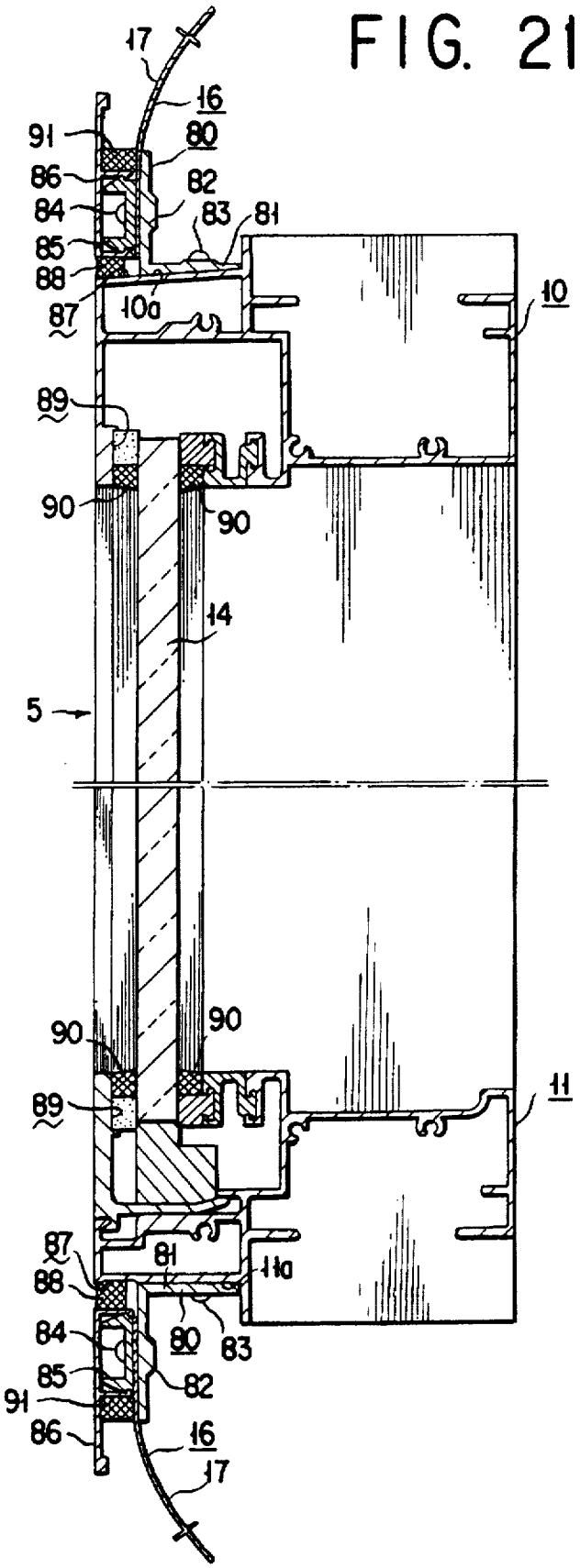
FIG. 21 is a cross section taken through FIG. 20 along the line XXI—XXI.
Figure 22:
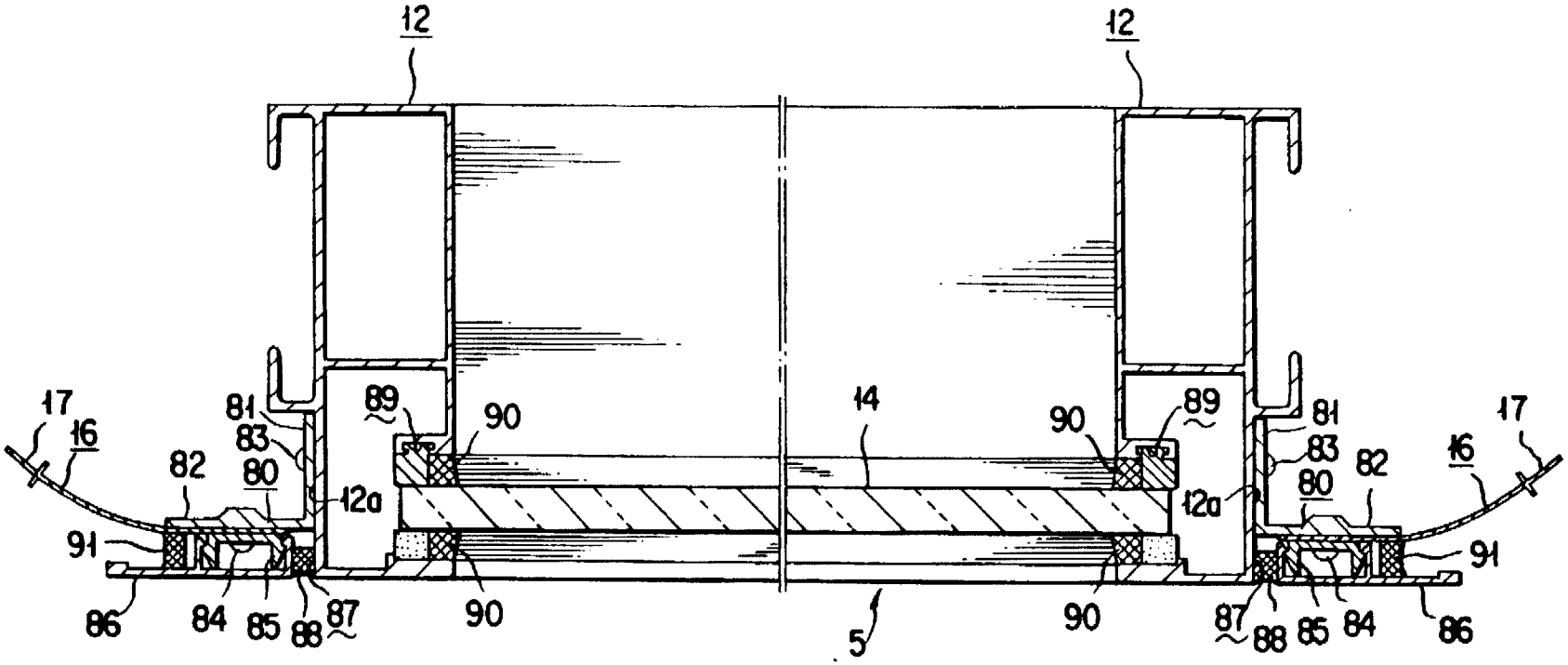
FIG. 22 is a cross section taken through FIG. 20 along the line XXII—XXII.

Hooklike tape fixing members 80 are fixed one each closely to the outdoor edge parts of the outdoor side surfaces 10*a*, 11*a*, and 12*a* of the frame members 10, 11, and 12 in the in-face direction in such a manner as to protrude from the surfaces. The tape fixing members 80, as shown in FIG. 21 and FIG. 22, are each formed of an attaching piece 81 and an outwardly turned piece 82 which are joined to form a cross section of the shape of the letter L. The fixing pieces 81 are severally fixed to the outer surfaces 10*a*, 11*a*, and 12*a* respectively of the frame members 10, 11, and 12 with screws 83. Repressing pieces 85 are fixed one each to the outwardly turned pieces 82 with screws 84. Cover members 86 are fixed in the manner of the snap-in engagement to the retaining pieces 85 to give rise to depressed parts 87 which open toward the outdoor side between the outer faces 10*a*, 11*a*, and 12*a* of the frame members 10, 11, and 12 and the relevant cover members 86.

The opposite end parts of the tape fixing members 80, the repressing pieces, and the cover members 86 are cut at an angle of 45 degrees and butt joined. The depressed parts 87 are filled throughout their combined length with a wet sealing material 88 to seal the gaps between the framework 13 and the tape fixing members 80.

The face member 14 is formed of a glass plate and, as shown in FIG. 21 and FIG. 22, is attached through the medium of a sealing member 90 to inwardly open groove 89 of the upper frame member 10, the lower frame member 11, and the left and right vertical frame members 12. The cladding unit 5 is an ordinary fixed fit sash.

The one-side edge parts of the waterproof tapes 17 of the component fastener stringers 16 of the waterproof slide fastener are attached as depressed with the depressing pieces 85 to the outwardly turned pieces 82 of the tape fixing members 80 and the gaps between the waterproof tapes 17 and the cover members 86 are sealed with a wet sealing material 91 so as to keep rainwater from infiltrating the waterproof tape fixing parts.

A frame material intended to form an ordinary fixed fit sash can be applied for the frame members 10, 11, and 12. It suffices specifically to fix the tape fixing members 80 one each to the outer faces 10*a*, 11*a*, and 12*a* of the frame members 10, 11, and 12 and attach the waterproof tapes 17 of the fastener stringers 16 to the tape fixing members 80.

Figure 23:
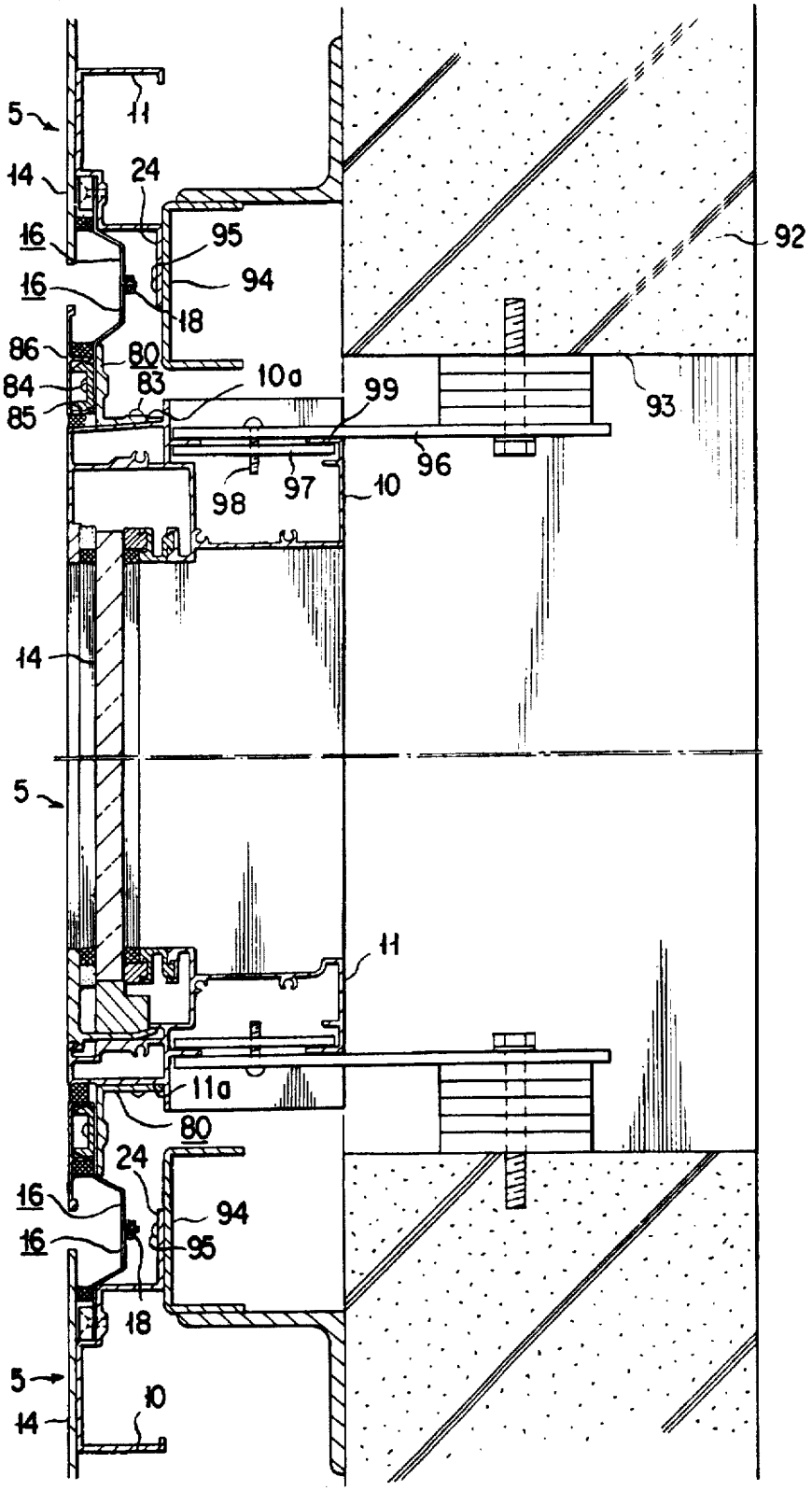
FIG. 23 and FIG. 24 are respectively a longitudinal section and a cross-sectional view showing a connecting part between a cladding unit having a face material thereof formed of a board material and a cladding unit having a face material thereof formed of a glass plate.
Figure 24:
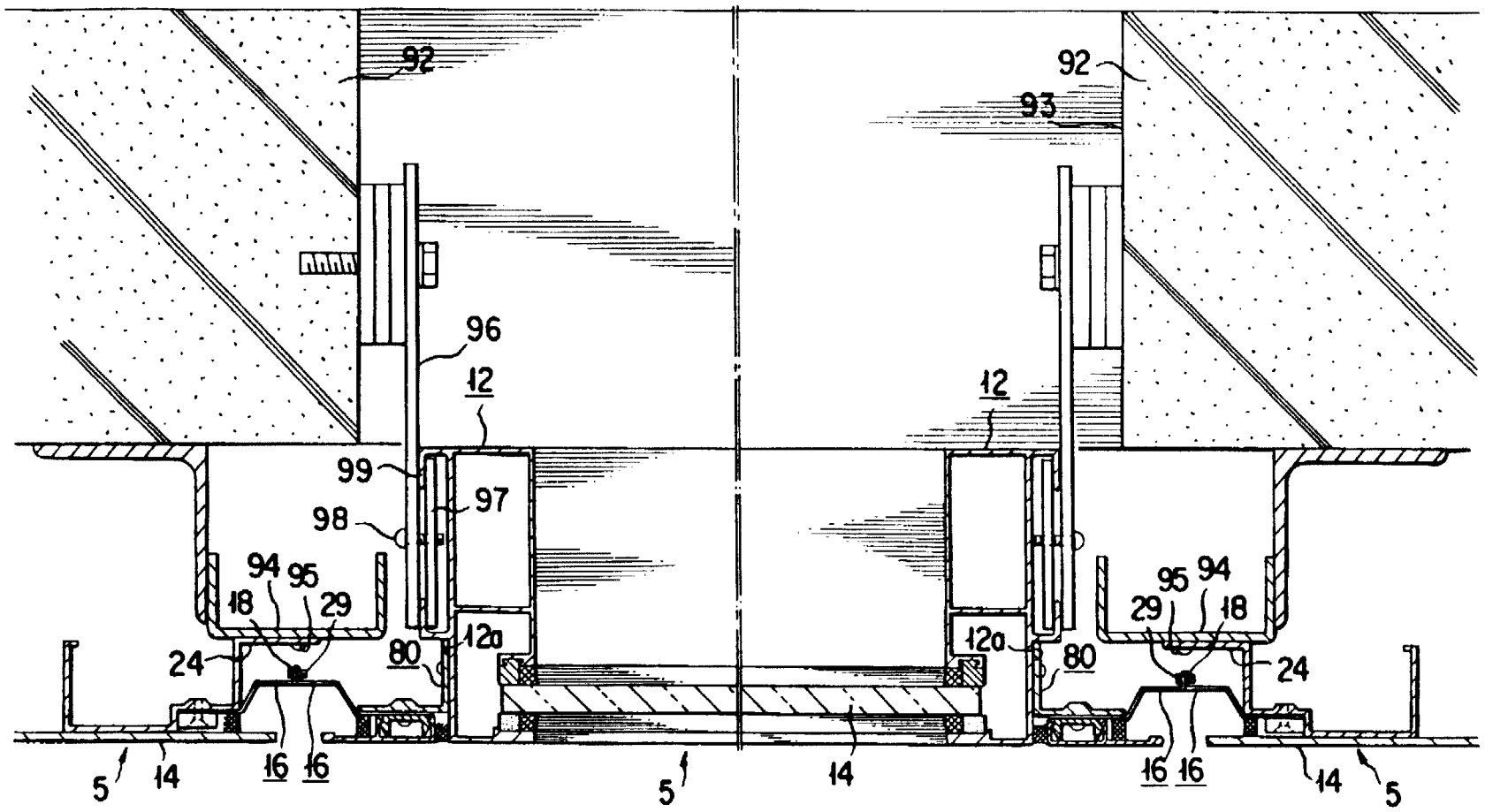

For the purpose of adjoining the cladding Unit 5 having the face member 14 formed of a glass plate to the cladding unit 5 of the first embodiment having the face member 14 formed of a board as shown in FIG. 2, it suffices to join the fixing pieces 24 of the frame members 10, 11, and 12 through the medium of fasteners 94 to the edge parts of an opening 93 of a skeleton frame 92 of a building by means of bolts 95, oppose the cladding units 5 to the opening 93 and fix the cladding units 5 in one plane, and unite the engaging parts 18 of the adjoining fastener stringers 16 by means of the slider as shown in FIG. 23 and FIG. 24. The cladding unit 5 having the face member 14 formed of a glass plate is fixed by causing flange parts 99 of the frame members 10, 11, and 12 to be nipped between a retaining member 97 and a bracket 96 secured to the skeleton frame 92 of the building so as to thrust out from the opening 93 and tying them with screws 98.

Optionally, the tape fixing members 80 may be integrally formed on the outer faces 10*a*, 11*a*, and 12*a* of the frame members 10, 11, and 12.

Now, an embodiment of fixing adjoining cladding units 5 in such a manner that their surfaces will not fall flush.

Figure 25:
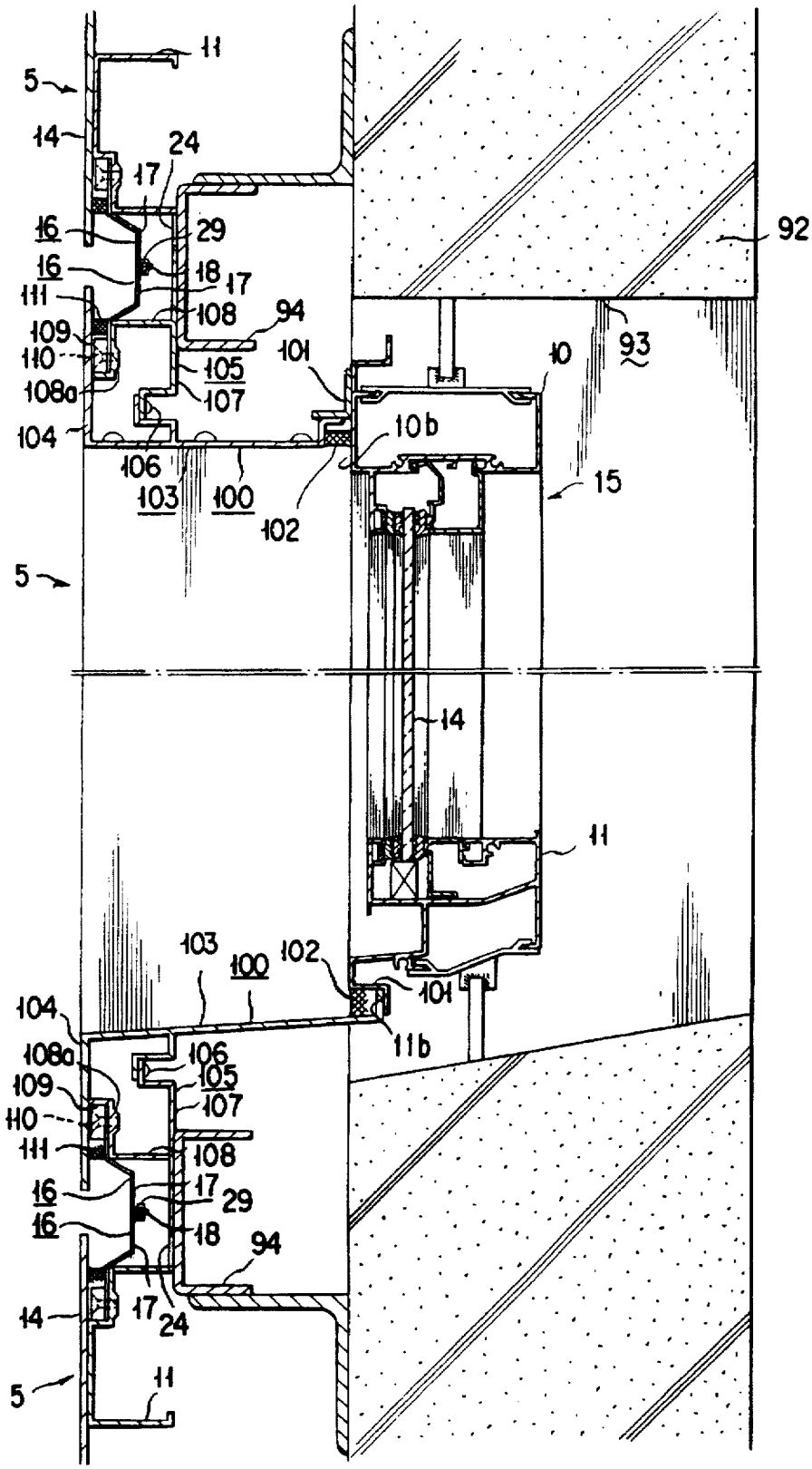
FIG. 25 and FIG. 26 are respectively a longitudinal section and a cross-sectional view showing an embodiment having adjoining cladding units so united that their surfaces do not fall flush.
Figure 26:
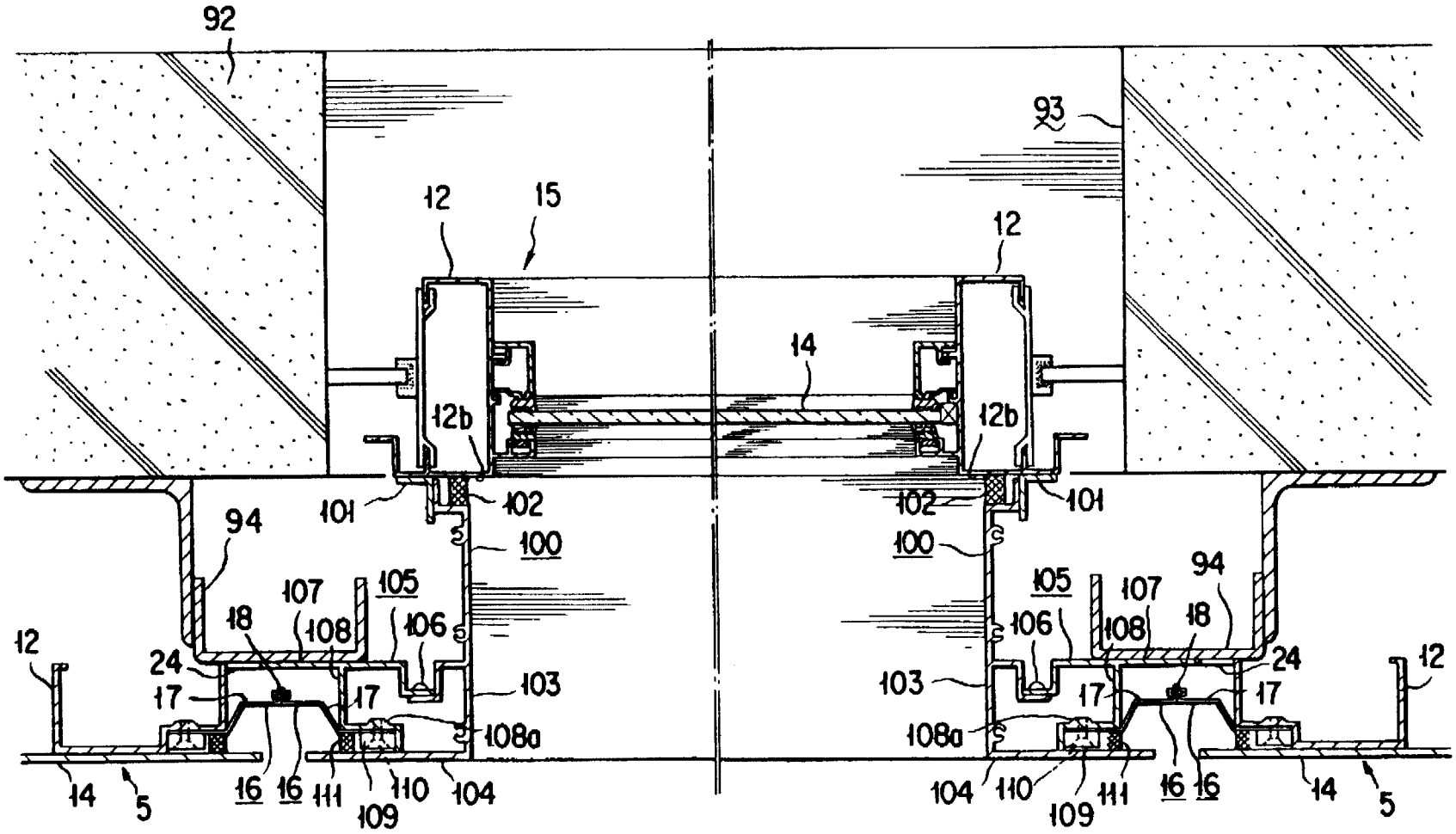

The fixing pieces 24 of the frame members 10, 11, and 12 of the cladding unit 5 having the face member 14 formed of a board are severally coupled to the fasteners 94 and fixed so as to thrust further on the outdoor side than the skeleton frame 92 of the building as shown in FIG. 25 and FIG. 26.

An ordinary cladding member 15 such as, for example, a fixed fitting sash or an open-close sash is disposed inside the opening 93 of the skeleton frame 92 of the building. Outer frames 100 are fixed one each through the medium of a fixing piece 101 to outdoor surfaces 10*b*, 11*b*, and 12*b* in the out-face direction respectively of the frame members 10, 11, and 12 of the cladding member 15 and the fixing parts thereof are sealed with a wet sealing material 102.

The outer frames 100 each comprise a first plate 103 extended in the out-face direction and a second plate 104 extended in the in-face direction and assume a substantially hook-shaped cross section. A tape fixing member 105 is fixed jointly to the first plate 103 and the second plate 104 by means of bolts 106. The tape fixing member 105 is provided with a fixing piece 107 and a hooklike projecting piece 108. The one-side edge parts of the waterproof tapes 17 of the component fastener stringers 16 are attached as depressed with the depressing pieces 109 by means of screws 110 to the hooklike pieces 108*a* of the hooklike projecting pieces 108 in the same manner as mentioned above. A wet sealing material 111 is filled in the gap between the second plates 104 and the waterproof tapes 17 of the fastener stringers 16.

As the fixing piece 107 of the tape fixing member 105 is fixed to the fastener 94, the second plate 104 falls flush with the face member 14 and the adjoining fastener stringers 16 are opposed to each other. The engaging parts 18 of the adjoining fastener stringers 16 are meshed with each other by means of the slider.

Owing to the structure described above, the gaps between the ordinary cladding member 15 and four cladding units 5 can be sealed with the waterproof slide fasteners when the ordinary cladding member 15 is fixed in the opening 93 of the skeleton frame 92 of the building and fixing the cladding units 5 having the face member 14 thereof formed of a board one each to the vertical and lateral edge parts of the opening 93.

While certain specific embodiments have been disclosed herein, the invention may be embodied in other specific forms without departing from the spirit or essential characteristics thereof. The described embodiments are therefore to be considered in all respects as illustrative and not restrictive, the scope of the invention being indicated by the appended claims rather than by the foregoing description and all changes which come within the meaning and range of equivalency of the claims are, therefore, intended to be embraced therein.

What is claimed is:

1. A cladding unit for a building adapted to sealingly engage with other cladding units of like construction, said cladding unit comprising:

a cladding member having a framework of interconnected framework portions defining a plurality of corners;

a face member attached to one side face of said framework;

waterproof slide fastener stringers comprising waterproof tapes, one each attached to one of said framework portions and having ends connected to adjacent of said fastener stringers sealingly forming joined corner parts protruding outwardly from said corners, and engaging parts, one each along a longitudinal edge of said waterproof tapes extending outward beyond said framework portion; and notches formed in said joined corner parts interrupting the continuity of said engaging parts.

2. The cladding unit according to claim 1, wherein said fastener stringers further comprise:

one end part of said engaging parts longitudinally protruding from said waterproof tapes beyond said joined corner parts from one end of each of said fastener stringers.

3. A sealed cruciform joint for a cladding structure for a building, said cruciform joint comprising:

first, second, third and fourth cladding units, each having a framework with a vertical and a lateral framework portion interconnected to define first, second, third and fourth corners, and a face member attached to one side face of said framework;

waterproof slide fastener stringers having waterproof tapes, one each attached to said lateral portions and vertical portions of said cladding units sealingly forming first, second, third and fourth joined corner parts protruding outwardly from said corners, and engaging parts, one each along one longitudinal edge of said waterproof tapes;

first, second, third and fourth notches formed in said first, second, third and fourth joined corner parts interrupting the continuity of said engaging parts;

said first, second, third and fourth cladding units being arranged having their respective of said corners adjacent and spaced from one another, said cladding units in combination defining a lateral joint between adjacent of said lateral portions and a vertical joint between adjacent of said vertical portions;

a lateral seal formed by coupling said engaging parts of said fastener stringers of said lateral joint;

a vertical seal formed by coupling said engaging parts of said fastener stringers of said vertical joint;

an opening defined by said notches; and a waterproof sheet sealingly disposed over said opening.

4. The sealed cruciform joint according to claim 3 wherein said waterproof sheet is a cruciform sheet constructed of a silicon resin.

5. A sealed T-shaped joint for a cladding structure of a building, said T-shaped joint comprising:

first and second cladding units each having a framework with a vertical and a lateral portion interconnected to define first and second corners, and a face member attached to one side face of said framework;

a third cladding unit having a framework with a lateral portion, and a face member attached to one side face of said framework;

waterproof slide fastener stringers having waterproof tapes, one each attached to said lateral portions and said vertical portions, and engaging parts, one each along one longitudinal edge of said waterproof tapes;

first and second joined corner parts formed by said fastener stringers of said vertical and lateral framework portions at said first and second corners;

first and second notches formed in said first and second corners interrupting the continuity of said engaging parts;

said first and second cladding units arranged having said first and second corners adjacent and spaced from one another, a vertical joint defined between adjacent of said vertical portions, and said third cladding unit arranged adjacent and spaced from said first and second cladding units with said lateral portion straddling said vertical joint, a lateral joint defined between adjacent of said lateral portions;

a vertical seal formed by coupling said engaging parts of said fastener stringers of said vertical joint;

a first lateral seal formed by coupling said engaging part of said lateral portion of said first cladding unit with a portion of said engaging part of said third cladding unit;

a second lateral seal formed by coupling said engaging part of said lateral portion of said second cladding unit with a portion of said engaging part of said third cladding unit;

an opening defined by said notches; and a waterproof sheet disposed over an opening.

6. The sealed T-shaped joint according to claim 5, wherein said waterproof sheet is a T-shaped sheet made of a silicon resin.

7. A sealed joint between an opening and a cladding structure carried on a building, said sealed joint comprising:

first and second cladding units each having a framework with a vertical and a lateral portion interconnected to define first and second corners, and a face member attached to one side face of each of said framework;

waterproof slide fastener stringers having waterproof tapes, one each attached to said vertical portions of said cladding units, and engaging parts, one each along one longitudinal edge of said waterproof tape;

waterproof tapes, one each attached to said lateral portions of said cladding units which join said waterproof tapes of said vertical portions at said corners sealingly forming first and second joined corner parts protruding outwardly from said corners;

said first and second cladding units arranged having their respective of said corners adjacent and spaced from one another with said lateral portions thereof arranged adjacent and spaced from a wall around said opening in said building defining a lateral joint therebetween, and with said vertical portions arranged parallel to and spaced from one another defining a vertical joint therebetween;

a vertical seal formed by coupling said engaging parts of said fastener stringers along said vertical joint; and a lateral seal formed by bending said waterproof tapes of said lateral portions and bending extending end parts of said fastener stringers such that they confront said wall defining gaps therebetween, and filling said gaps with a wet sealing material.

8. The sealed joint according to claim 7, wherein said waterproof tapes attached to said lateral portions comprise fastener stringers.

9. An sealed joint between an opening in and a cladding structure carried on a building, said joint comprising:

first and second cladding units each having a framework with a vertical and a lateral portion interconnected to define first and second corners, and a face member attached to one side face of each of said framework;

waterproof slide fastener stringers having waterproof tapes, one each attached to said vertical portions of said cladding units, and engaging parts, one each along one longitudinal edge of said waterproof tape;

waterproof tapes, one each attached to said lateral portions of said cladding units which join said waterproof tapes of said vertical portions at said corners sealingly forming first and second joined corner parts protruding outwardly from said corners;

said first and second cladding units arranged having their respective of said corners adjacent and spaced from one another with said lateral portions thereof arranged adjacent and spaced from a wall around said opening in said building defining a lateral joint therebetween, and with said vertical portions arranged parallel to and spaced from one another defining a vertical joint therebetween;

a vertical seal formed by coupling said engaging parts of said fastener stringers along said vertical joint;

a waterproof sheet sealingly attached over said lateral portions at said joined corner parts; and a lateral seal formed by bending said waterproof tapes of said lateral portions, bending extending end parts of said fastener stringers, and bending a portion of said sheet such that they confront said wall defining a gap therebetween, and filling said gap with a wet sealing material.

10. The sealed joint of claim 9, wherein said waterproof tapes attached to said lateral portions comprise fastener stringers.

11. A sealed joint between a protruding contoured obstacle on and a cladding structure carried by a building, said sealed joint comprising:

first and second cladding units each having a framework with a depressed and a remaining portion interconnected to define at least first and second corners, said depressed parts jointly conforming to said contoured obstacle, and a face member attached to one side face of each of said framework;

waterproof slide fastener stringers having waterproof tapes, one each attached to said remaining portions of said cladding units and engaging parts, one each along one longitudinal edge of said waterproof tapes; and waterproof tapes attached to said depressed portions of said cladding units which join to said waterproof tapes of said remaining portions at said corners sealingly forming first and second joined corner parts protruding outwardly from said corners;

said first and second cladding units being arranged having their respective of said corners adjacent and spaced from one another with said depressed portions thereof arranged adjacent said contoured obstacle spaced therefrom defining a contoured joint therebetween, and with parts of said remaining portions arranged adjacent to and spaced from one another defining a remaining joint therebetween;

a remaining seal formed by coupling said engaging parts of said fastener stringers of said remaining joint; and a contoured seal formed by bending said waterproof tapes of said contoured joint such that they are confronting said obstacle defining gaps therebetween, and filling said gaps with a wet sealing material.

* * * * *